US010543519B2

(12) United States Patent
Okada et al.

(10) Patent No.: US 10,543,519 B2
(45) Date of Patent: Jan. 28, 2020

(54) MANUFACTURING METHOD FOR BENT MEMBER AND HOT-BENDING APPARATUS FOR STEEL MATERIAL

(71) Applicant: NIPPON STEEL & SUMITOMO METAL CORPORATION, Tokyo (JP)

(72) Inventors: Nobuhiro Okada, Kisarazu (JP); Hiroaki Kubota, Toyota (JP); Atsushi Tomizawa, Nago (JP)

(73) Assignee: NIPPON STEEL CORPORATION, Tokyo (JP)

( * ) Notice: Subject to any disclaimer, the term of this patent is extended or adjusted under 35 U.S.C. 154(b) by 592 days.

(21) Appl. No.: 15/313,310

(22) PCT Filed: May 27, 2015

(86) PCT No.: PCT/JP2015/065277
§ 371 (c)(1),
(2) Date: Nov. 22, 2016

(87) PCT Pub. No.: WO2015/182666
PCT Pub. Date: Dec. 3, 2015

(65) Prior Publication Data

US 2017/0197237 A1 Jul. 13, 2017

(30) Foreign Application Priority Data

May 27, 2014 (JP) ..... 2014-109361
Oct. 10, 2014 (JP) ..... 2014-209052
Dec. 4, 2014 (JP) ..... 2014-245639

(51) Int. Cl.
*B21D 9/04* (2006.01)
*B21D 7/16* (2006.01)
*B21D 7/12* (2006.01)

(52) U.S. Cl.
CPC ..... *B21D 9/04* (2013.01); *B21D 7/12* (2013.01); *B21D 7/16* (2013.01)

(58) Field of Classification Search
CPC . B21D 7/02; B21D 7/024; B21D 7/04; B21D 7/12; B21D 7/16; B21D 7/162;
(Continued)

(56) References Cited

U.S. PATENT DOCUMENTS 4,479,372 A 10/1984 Watanabe
8,511,135 B2 8/2013 Kuwayama et al.
(Continued)

FOREIGN PATENT DOCUMENTS

CN 102361706 A 2/2012
EP 1 857 195 A1 11/2007
(Continued)

OTHER PUBLICATIONS

Translation, JP 56-134022A, Oct. 1981.*
(Continued)

*Primary Examiner* — Edward T Tolan
(74) *Attorney, Agent, or Firm* — Birch, Stewart, Kolasch & Birch, LLP

(57) ABSTRACT

A manufacturing method for a bent member of the present invention includes a holding step of holding one end portion of a long steel material having an opening end in a longitudinal direction by a chuck, a feeding step of feeding the steel material in the longitudinal direction with the one end portion as a head after the holding step, a heating step of performing high-frequency induction heating on a portion of the steel material in the longitudinal direction to form a heated portion, a bending step of moving the chuck in a three-dimensional direction to apply a bending moment to the heated portion, and a cooling step of injecting a cooling medium to the heated portion to cool the heated portion after
(Continued)

the bending step. When the heating step is started, the chuck is cooled by the cooling medium in a state where a heating amount applied to the one end portion when the heated portion is formed on the one end portion is greater than that of an upstream side adjacent portion adjacent to the upstream side of the one end portion as seen along a feeding direction of the steel material.

14 Claims, 21 Drawing Sheets

(58) Field of Classification Search
CPC . B21D 7/164; B21D 9/04; B21D 9/07; B21D 37/16
See application file for complete search history.

(56) References Cited

U.S. PATENT DOCUMENTS

| | | | | |
|---|---|---|---|---|
| 8,528,380 | B2 * | 9/2013 | Kuwayama | B21D 7/162 72/369 |
| 8,919,171 | B2 * | 12/2014 | Tomizawa | B21D 7/08 72/128 |

FOREIGN PATENT DOCUMENTS

| | | | | |
|---|---|---|---|---|
| EP | 2 433 722 | A1 | 3/2012 | |
| JP | 52-141408 | A | 11/1977 | |
| JP | 56-134022 | A * | 10/1981 | B21D 7/16 |
| JP | 62-18245 | B2 | 4/1987 | |
| JP | 1-249224 | A * | 10/1989 | B21D 7/16 |
| JP | 6-277764 | A | 10/1994 | |
| JP | 2008-23573 | A | 2/2008 | |
| SU | 119774 | A1 | 11/1958 | |
| SU | 1360576 | A3 | 12/1987 | |
| WO | WO 2006/093006 | A1 | 9/2006 | |
| WO | WO 2010/134495 | A1 | 11/2010 | |

OTHER PUBLICATIONS

Translation, JP 1-249224A, Oct. 1989.*
Chinese Office Action and Search Report for counterpart Chinese Application No. 201580027091.0, dated Dec. 4, 2017, with English translation of the Search Report.
Russian Office Action and Search Report for counterpart Russian Application No. 2016146105, dated Jan. 31, 2018, with English translation.
International Search Report for PCT/JP2015/065277 dated Aug. 25, 2015.
Majima et al., "Application of Tube Hydroforming to Automotive Parts", Automotive Technology, 2003, vol. 57, No. 6, pp. 23-28.
Written Opinion of the International Searching Authority for PCT/JP2015/065277 (PCT/ISA/237) dated Aug. 25, 2015.

* cited by examiner

MANUFACTURING METHOD FOR BENT MEMBER AND HOT-BENDING APPARATUS FOR STEEL MATERIAL

TECHNICAL FIELD OF THE INVENTION

The present invention relates to a manufacturing method for a bent member and a hot-bending apparatus for a steel material.

Priority is claimed on Japanese Patent Application No. 2014-109361, filed on May 27, 2014, Japanese Patent Application No. 2014-209052, filed on Oct. 10, 2014, and Japanese Patent Application No. 2014-245639, filed on Dec. 4, 2014, the contents of which are incorporated herein by reference.

RELATED ART

A metal strength member, reinforced member, or structural member (hereinafter, referred to as a "bent member") having a bent shape is used in automobile, various machines, or the like. A member having high strength, light weight, and a small size is required for the bent member. In the related art, for example, in order to manufacture the bent member, a method such as welding of a pressed product or punching and forging of a thick plate is used. However, high-strengthening, a decrease in weight, and a decrease in size of the bent member are further required.

Non-Patent Document 1 discloses a method for manufacturing a bent member by a tube hydro-forming method which processes a steel pipe by applying a hydraulic pressure to the inside of a steel pipe. According to the tube hydro-forming method, it is possible to improve thinning of a plate thickness of the manufactured bent member, shape flexibility, and economic efficiency related to the manufacturing of the bent member. However, there are problems that a material which can be used for the tube hydro-forming method is limited, shape flexibility is not sufficient in bending using the tube hydro-forming method, or the like.

The inventors have developed a manufacturing method for a bent member and a hot-bending apparatus for a steel material in consideration of the above-described circumstances (refer to Patent Document 1). FIG. 12 is an explanatory view showing an outline of a hot-bending apparatus 0 for a steel material disclosed in Patent Document 1.

As shown in FIG. 12, in a hot-bending apparatus 0 for a steel material, a bent member 8 is manufactured by bending a steel pipe 1 on the downstream side of a support device 2 while feeding the steel pipe 1 which is movably supported in a longitudinal direction by the support device 2 from the upstream side toward the downstream side by a feeding device 3 using a ball screw, for example.

That is, a heated portion 1*a* is formed in a portion of the steel pipe 1 in the longitudinal direction by rapidly heating a portion of the steel pipe 1 to a quenchable temperature range by an induction heating device 5 on the downstream side of the support device 2. After the heating is performed, the steel pipe 1 is rapidly cooled by a cooling device 6 which is disposed on the downstream side of the induction heating device 5. A bending moment is applied to the heated portion 1*a* by moving the end portion of the steel pipe 1 in a three-dimensional direction while feeding the steel pipe 1 in the longitudinal direction between the heating and the cooling.

It is possible to quench the steel pipe 1 by controlling a heating temperature and a cooling rate of the steel pipe 1. Therefore, according to the method for manufacturing the bent member 8 using the hot-bending apparatus 0 for a steel material, it is possible to realize high-strengthening, a decrease in weight, and a decrease in size of the bent member 8. In the present specification, the manufacturing method for the bent member 8 using the hot-bending apparatus 0 of a steel material is referred to as a 3DQ (abbreviation for "3 Dimensional Hot Bending and Quench").

In a case where the bent member 8 is manufactured by the 3DQ, it is necessary to appropriately hold a front end section and a rear end section of the steel pipe 1 in a feeding direction. The inventors have developed a chuck for holding the steel pipe 1 (refer to Patent Document 2).

FIG. 13A is a schematic view for explaining a case where the inner portion of the steel pipe 1 is held by a short chuck 10 supported by a drive mechanism 9. In addition, in FIG. 13A, the cooling device 6 is omitted. Moreover, in following descriptions, the case which uses the chuck holding the inside of the steel pipe 1 is exemplified. However, the chuck may hold the outer portion of the steel pipe 1.

The chuck 10 is a stepped tubular body having a large-diameter portion 10*a* and a small-diameter portion 10*b*. In the present specification, the small-diameter portion 10*b* is also referred to as a click 10*b*.

The large-diameter portion 10*a* has the same outer diameter as the outer diameter of the steel pipe 1. On the other hand, the small-diameter portion 10*b* has a predetermined length in an axial direction, and is inserted into a front end section 1*b* or a rear end section 1*d* of the steel pipe 1. The small-diameter portion 10*b* is configured so that the diameter of the small-diameter portion 10*b* can be freely increased and decreased. By increasing the diameter of the small-diameter portion 10*b*, the outer surface of the small-diameter portion 10*b* abuts on the inner surface of the front end section 1*b* or the rear end section 1*d* of the steel pipe 1, and the small-diameter portion 10*b* holds the front end section 1*b* or the rear end section 1*d* of the steel pipe 1.

FIG. 13B is a schematic view for explaining a case where the inner portion of the front end section 1*b* or the rear end section 1*d* of the steel pipe 1 is held by a long chuck 11 supported by the drive mechanism 9. The chuck 11 is a stepped tubular body having a large-diameter body portion 11*a* and a small-diameter insertion portion 11*b*. The method for bending the steel pipe 1 in the case which uses the short chuck 10 is similar to that of the case which uses the long chuck 11.

In addition, in the case where the front end section 1*b* of the steel pipe 1 is held and the case where the rear end section 1*d* is held, the holding method performed by the chuck 10 is similar to the holding method performed by the chuck 11.

PRIOR ART DOCUMENT

Patent Document

[Patent Document 1] Pamphlet of PCT International Publication No. WO 2006-093006

[Patent Document 2] Pamphlet of PCT International Publication No. WO 2010-134495

[Non-Patent Document] 23 to 28 Pages, No. 6, Vol. 57, Automobile Technology, 2003.

DISCLOSURE OF THE INVENTION

Problems to be Solved by the Invention

The present inventors have further examined improvement on productivity and economic efficiency of the bent member 8 by the 3DQ using the chuck 10 or 11, and have found the following problems. In addition, in the following descriptions, the case where the bent member is manufactured using the short chuck 10 is described as an example. However, the case where the bent member is manufactured using the long chuck 11 is also similar.

In a case in which the vicinity of the front end section 1*b* of the steel pipe 1 is bent in a state where the front end section 1*b* of the steel pipe 1 is held by the chuck 10, when the steel pipe 1 is heated by the induction heating device 5, it is necessary to prevent the small-diameter portion 10*b* of the chuck 10 holding the front end section 1*b* of the steel pipe 1 from being heated higher than 500° C., for example. This is because the small-diameter portion 10*b* of the chuck 10 holding the front end section 1*b* of the steel pipe 1 may be fatigue-fractured in a case the small-diameter portion 10*b* of the chuck 10 holding the front end section 1*b* of the steel pipe 1 is heated higher than 500° C.

In order to prevent the small-diameter portion 10*b* of the chuck 10 holding the front end section 1*b* of the steel pipe 1 from being heated higher than 500° C., a method is considered, in which induction heating performed by the induction heating device 5 is started at a portion separated from the front end section 1*b* of the steel pipe 1. However, since the vicinity of the front end section 1*b* is not heated to be equal to or higher than a quenchable temperature in the case where the induction heating performed by the induction heating device 5 is started at the portion separated from the front end section 1*b* of the steel pipe 1, many portions (hereinafter, referred to as "non-quenching portions") in which quenching is not performed are generated in the vicinity of the front end section 1*b*.

Since strength of the non-quenching portion is low, the non-quenching portion becomes an unnecessary portion in a component in which strength is required, and the non-quenching portion may be cut. Since a cutting step increases in a case where the non-quenching portion is cut, productivity of the bent member decreases. In addition, since the unnecessary portion is cut from the manufactured bent member and a portion which does not become a product in the steel pipe which is a material is generated, economic efficiency decreases.

Accordingly, from the viewpoint of productivity and economic efficiency, starting the induction heating performed by the induction heating device 5 at the portion separated from the front end section 1*b* of the steel pipe 1 to prevent the small-diameter portion 10*b* of the chuck 10 holding the front end section 1*b* of the steel pipe 1 from being heated higher than 500° C. is not preferable.

FIGS. 14A to 14D are schematic views for explaining a case in which manufacturing of a bent member is started in a state where the front end section 1*b* of the steel pipe 1 is held by the chuck 10 with time using the method of the related art. In addition, in the FIGS. 14A to 14D, only a set of support units 2 is shown.

FIG. 14A shows a state at a time $t_0$ when the induction heating of the steel pipe 1 performed by the induction heating device 5 and the feeding of the steel pipe 1 performed by the feeding device 3 are not started.

At the time $t_0$, the front end section 1*b* of the steel pipe 1 is positioned at the position at which the front end section 1*b* can be heated by the induction heating device 5. If it proceeds from the time $t_0$ to a time $t_1$, the feeding of the steel pipe 1 performed by the feeding device 3, the heating of the steel pipe 1 performed by the induction heating device 5, and cooling of the steel pipe 1 performed by injecting a cooling medium from the cooling device 6 are started (refer to FIG. 14B).

In a time $t_2$ when a distance between the front end section 1*b* of the steel pipe 1 and the center portion of the heated portions 1*a* in the longitudinal direction reaches a predetermined distance $L_2$ in a state where the feeding of the steel pipe 1 performed by the feeding device 3, the heating of the steel pipe 1 performed by the induction heating device 5, and the cooling of the steel pipe 1 performed by injecting a cooling medium from the cooling device 6 are continued, a bending moment is applied to the heated portion 1*a* by moving the chuck 10 in a three-dimensional direction by the drive mechanism 9 (refer to FIG. 14C).

The bending moment is applied to the heated portions 1*a*, and a bent portion 1*c* is formed in the steel pipe 1 at a time $t_3$ (refer to FIG. 14D).

However, the inventors found that the heated portion 1*a* formed in the vicinity of the front end section 1*b* of the steel pipe 1 could not be heated to a desired temperature and bending could not be appropriately performed in the case where the front end section 1*b* of the steel pipe 1 was bent by the method shown in FIGS. 14A to 14D.

In a case where the heating temperature of the heated portion 1*a* formed in the vicinity of the front end section 1*b* of the steel pipe 1 is lower than 900° C., an excessive load is applied to the drive mechanism 9 when bending is performed by the drive mechanism 9, and the drive mechanism 9 is likely to be damaged.

900° C. to 1000° C. are examples of the temperature of the heated portion 1*a* for appropriately performing the bending. If the temperature of the heated portion 1*a* is 900° C. to 1000° C., the bending can be appropriately performed to the heated portion 1*a*, the heated portion 1*a* is cooled by injecting the cooling medium from the cooling device 6, and it is possible to perform quenching on the heated portion 1*a*.

From the above-described reasons, a manufacturing method for a bent member is required, by which the size of the non-quenching portion formed in the front end section 1*b* of the steel pipe 1 decreases as much as possible, and the small-diameter portion 10*b* of the chuck 10 holding the front end section 1*b* of the steel pipe 1 is not heated higher than 500° C.

Means for Solving the Problem

In order to solve the above-described problems and achieve the object, the present invention adopts the following means.

(1) According to an aspect of the present invention, there is provided a manufacturing method for a bent member, including the steps of: a holding step of holding one end portion of a long steel material having an opening end in a longitudinal direction by a chuck, a feeding step of feeding the steel material after the holding step along the longitudinal direction with the one end portion as a head, a heating step of forming a heated portion by high-frequency induction heating of a portion of the steel material in the longitudinal direction, a bending step of applying a bending moment to the heated portion by moving the chuck in a three-dimensional direction, and a cooling step of cooling the heated portion by injecting a cooling medium to the heated portion after the bending step. When the heating step is started, the chuck is cooled by the cooling medium, and a heating amount, which is applied to the one end portion when the heated portion is formed on the one end portion, is greater than that of an upstream side adjacent portion adjacent to an upstream side of the one end portion as seen along a feeding direction of the steel material.

(2) In the manufacturing method for a bent member disclosed in (1), a configuration may be adopted in which the heating amount applied to the one end portion when the heated portion is formed on the one end portion is greater than that of the upstream side adjacent portion when the heating step is started by changing at least one of a feeding speed of the steel material in the longitudinal direction in the feeding step and a heating amount which is applied to the portion in the heating step.

(3) In the manufacturing method for a bent member disclosed in (1) or (2), a configuration may be adopted in which the heating amount applied to the one end portion when the heated portion is formed on the one end portion is greater than that of the upstream side adjacent portion by starting the feeding step after a predetermined time from the heating step is started.

(4) In the manufacturing method for a bent member disclosed in any one of (1) to (3), a configuration may further contain a temperature measuring step of measuring a temperature of the steel material at a plurality of points in the longitudinal direction is further provided, and in the feeding step, a feeding speed of the steel material in the longitudinal direction is determined based on a temperature measurement result obtained in the temperature measuring step.

(5) In the manufacturing method for a bent member disclosed in any one of (1) to (4), a configuration may be adopted in which a heating amount applied to the other end portion of the steel material in the longitudinal direction when the heated portion is formed on the other end portion is greater than that of a downstream side adjacent portion adjacent to a downstream side of the other end portion as seen along the feeding direction of the steel material.

(6) In the manufacturing method for a bent member disclosed in (5), a configuration may be adopted in which the heating amount applied to the other end portion when the heated portion is formed on the other end portion is greater than that of the downstream side adjacent portion by changing at least one of a feeding speed of the steel material in the longitudinal direction in the feeding step and a heating amount in the heating step before the high-frequency heating stops in the heating step.

(7) In the manufacturing method for a bent member disclosed in (6), a configuration may be adopted in which the heating amount applied to the other end portion when the heated portion is formed on the other end portion is greater than that of the downstream side adjacent portion by stopping a feeding of the steel material in the feeding step before the high-frequency induction heating stops.

(8) In the manufacturing method for a bent member disclosed in any one (1) to (7), a configuration may be adopted in which the heating amount in the heating step is controlled to satisfy all the conditions of a first condition in which a heating temperature of a click of the chuck is 500° C. or lower, a second condition in which a heating temperature of the heated portion is higher than an Ac3 point when the bending moment is applied to the heated portion in the bending step, and a third condition in which a highest arrival temperature of the steel material is lower than or equal to a temperature at which a particle-coarsening of the steel material proceeds or is lower than or equal to a temperature at which a toughness of the steel material decreases.

(9) In the manufacturing method for a bent member disclosed in any one of (1) to (8), a configuration may be adopted in which the high-frequency induction heating includes: a first heating step of forming a first heated portion at a position between the one end portion and the other end portion of the steel material, a second heating step of forming a second heated portion at a position on the upstream side of the first heated portion of the steel material, and a heating stop step of forming a non-quenching portion between the first heated portion and the second heated portion, by stopping the high-frequency induction heating between the first heating step and the second heating step. A heating amount which is applied to the second heated portion is greater than a heating amount which is applied to the first heated portion when the second heating step is started.

(10) In the manufacturing method for a bent member disclosed in (9), a configuration may be adopted in which a width dimension of the non-quenching portion is 0.15 times or more and 1.40 times or less of a heating width by the high-frequency induction heating as seen along the longitudinal direction.

(11) According to another aspect of the present invention, there is provided a hot-bending apparatus for a steel material, including: a chuck which holds one end portion of a long steel material having an opening end in a longitudinal direction; a drive mechanism which moves the chuck in a three-dimensional direction; a feeding mechanism which feeds the steel material along the longitudinal direction with the one end portion as a head; an induction heating mechanism which performs high-frequency induction heating on a portion of the steel material in the longitudinal direction to form a heated portion; a cooling mechanism which injects a cooling medium to the heated portion to cool the heated portion; and a controller which controls the chuck, the drive mechanism, the feeding mechanism, the induction heating mechanism, and the cooling mechanism. When the heated portion is formed on the one end portion by the induction heating mechanism the controller controls to satisfy the conditions of: a heating amount is greater than that of an upstream side adjacent portion adjacent to an upstream side of the one end portion as seen along a feeding direction of the steel material; and the cooling mechanism cools the chuck by the cooling medium.

(12) In the hot-bending apparatus of a steel material disclosed in (11), a configuration may be adopted in which the controller controls to cause a heating amount applied to the other end portion of the steel material in the longitudinal direction by the induction heating mechanism to be greater than that of a downstream side adjacent portion adjacent to a downstream side of the other end portion as seen along the feeding direction of the steel material when the heated portion is formed on the other end portion.

(13) In the hot-bending apparatus for a steel material disclosed in (11) or (12), a configuration is adopted in which the controller controls the induction heating mechanism to form: a first heated portion at a position between the one end portion and the other end portion of the steel material, a second heated portion at a position on the upstream side of the first heated portion of the steel material, and a non-quenching portion at a position between the first heated portion and the second heated portion.

(14) In the hot-bending apparatus for a steel material according to any one of (11) to (13), a configuration may be adopted in which at least one of a first temperature measurement mechanism which measures a temperature of the one end portion, a second temperature measurement mechanism which measures a temperature of the heated portion, and a shape measurement mechanism which measures an outline distortion amount of the one end portion is provided, and the controller controls at least one of the feeding mechanism and the induction heating mechanism so that at least one of the temperature of the one end portion, the temperature of the heated portion, and the outline distortion amount of the one end portion is within a predetermined range.

Effects of the Invention

According to each of the above-described aspects, it is possible to prevent fatigue fracture of the chuck holding the front end section of the steel material, and it is possible to provide a manufacturing method for a bent member and a hot-bending apparatus for a steel material having improved productivity and economic efficiency.

BRIEF DESCRIPTION OF THE DRAWINGS

FIG. 2(*b*) is a graph which shows a temperature on the surface of the steel pipe when the induction heating device is positioned at an A point with respect to the position on the steel pipe. FIG. 2(*c*) is a graph which shows a highest arrival temperature with respect to the position on the steel pipe. FIG. 2(*d*) is a graph which shows hardness with respect to the position on the steel pipe.

FIG. 3(*b*) is a graph which shows a feeding speed of the steel pipe in Aspect Example 1-1 with respect to time.

FIG. 5(*b*) is a graph which shows a feeding speed of the steel pipe in Aspect Example 1-2 with respect to time.

FIG. 6(*b*) is a graph which shows a feeding speed of the steel pipe in Aspect Example 1-3 with respect to time.

FIG. 8(*b*) is a graph which shows hardness of the steel pipe in Example 1 with respect to the position on the steel pipe.

FIG. 9(*b*) is a graph which shows the highest arrival temperatures at the positions A and B with respect to the position on the steel pipe. FIG. 9(*c*) is a graph which shows the hardness of the steel pipe at the positions A and B with respect to the position on the steel pipe.

FIG. 10(*b*) is a graph which shows a feeding speed of the steel pipe in Example 1-1 with respect to time. FIG. 10(*c*) is a graph which shows high-frequency electric energy supplied to an induction heating device of Example 1-2 with respect to time. FIG. 10(*d*) is a graph which shows a feeding speed of the steel pipe in Example 1-2 with respect to time. FIG. 10(*e*) is a graph which shows high-frequency electric energy supplied to an induction heating device of Example 1-3 with respect to time. FIG. 10(*f*) is a graph which shows a feeding speed of the steel pipe in Example 1-3 with respect to time.

FIG. 11(*b*) is a graph which shows a feeding speed of the steel pipe in Comparative Example 1-1 with respect to time.

FIG. 16(*b*) is a graph which shows a relationship between hardness and the position on the steel pipe in the vicinity of the rear end section of the steel pipe.

FIG. 17(*b*) is a simulation result which shows a relationship between hardness and the position on the steel pipe when it is assumed that the heating amount applied to the position A shown in FIG. 9(*a*) is greater by 10% than the heating amount applied to the position B when the vicinity of the rear end section of the steel pipe is bent.

FIG. 18(*e*) is a graph which shows a relationship between the hardness of the steel pipe and the position on the steel pipe after the bending shown in FIGS. 18(*a*) to 18(*d*) is performed.

FIG. 19(*e*) is a graph which shows a relationship between the hardness of the steel pipe and the position on the steel pipe after the bending shown in FIGS. 19(*a*) to 19(*d*) is performed.

FIG. 20(*b*) is a graph which shows a feeding speed of the steel pipe in Example 2-1 with respect to time. FIG. 20(*c*) is a graph which shows high-frequency electric energy supplied to an induction heating device of Example 2-2 with respect to time. FIG. 20(*d*) is a graph which shows a feeding speed of the steel pipe in Example 2-2 with respect to time. FIG. 20(*e*) is a graph which shows high-frequency electric energy supplied to an induction heating device of Example 2-3 with respect to time. FIG. 20(*f*) is a graph which shows a feeding speed of the steel pipe in Example 2-3 with respect to time.

FIG. 21(*b*) is a graph which shows a feeding speed of the steel pipe in Comparative Example 2-1 with respect to time.

FIG. 26(*b*) is a graph which shows a feeding position of the steel pipe in Example 3-1 with respect to time.

FIG. 27(*b*) is a graph which shows a feeding position of the steel pipe in Example 3-2 with respect to time.

FIG. 28(*b*) is a graph which shows a feeding position of the steel pipe in Example 3-3 with respect to time.

EMBODIMENT(S) OF THE INVENTION

[Manufacturing Method for Bent Member]

Figure 1A:
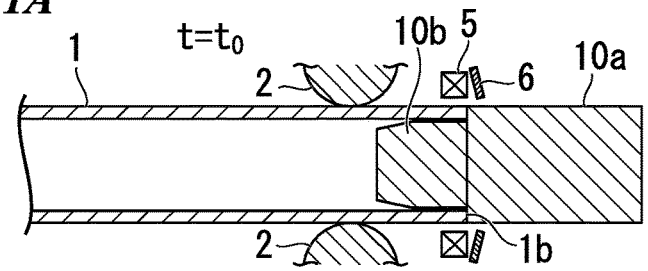
FIG. 1A is a schematic view showing states of a steel pipe and a hot-bending apparatus for a steel pipe in a case where the vicinity of a front end section of the steel pipe is bent according to the present invention.

Hereinafter, embodiments of the present invention will be described with reference the accompanying drawings. In the following descriptions, an example in a case where a steel pipe in which the cross section is a circular shape is bent is described. However, the present invention can be also applied to a steel pipe in which the cross section is a rectangular shape as long as it is a long steel pipe having an opening end. In addition, the same reference numerals are assigned to the same members, and overlapping descriptions are appropriately omitted.

First Embodiment

In a manufacturing method for a bent member according to a first embodiment, when a front end section of a steel pipe is bent, by decreasing a non-quenching portion formed on the front end section of the steel pipe as much as possible and heating a small-diameter portion of a chuck holding the front end section of the steel pipe such that the heated temperature be not higher than 500° C., productivity and economic efficiency in the manufacturing of the bent member are improved, and fatigue fracture of the small-diameter portion of the chuck holding the front end section of the steel pipe is prevented.

FIGS. 1A to 1E are schematic views showing states of a steel pipe 1 and a hot-bending apparatus 0 for a steel pipe in a case where the vicinity of a front end section 1*b* of the steel pipe 1 is bent according to the present invention. FIGS. 1A to 1E respectively show the states of the steel pipe 1 and the hot-bending apparatus 0 for a steel pipe at times $t_0$, $t_1$, $t_2$, $t_3$, and $t_4$. In addition, the time $t_1$ is a time when $\Delta t$ seconds elapse from the time $t_0$.

As shown in FIG. 1A, at the time $t_0$, the steel pipe 1 is disposed at a position at which the steel pipe 1 is heated by an induction heating device 5 so as to be induction-heated along the longitudinal direction (right direction in FIG. 1A) with the front end section 1*b* as a starting point.

Next, the feeding of the steel pipe 1 with the front end section 1*b* as a head in the longitudinal direction by a feeding device 3 and induction heating (high-frequency induction heating) of the steel pipe 1 performed by a heating device 5 are started. In the feeding direction of the steel pipe 1, a cooling medium (cooling water) is injected from a cooling device 6 which is disposed so as to be separated from the induction heating device 5 on the downstream side of the induction heating device 5, and the steel pipe 1 which is heated by the induction heating device 5 is cooled.

The steel pipe 1 is heated by the induction heating device 5, and a heated portion 1*a* is formed on the steel pipe 1. As shown in FIGS. 1B to 1E, the position of the heated portion 1*a* formed on the steel pipe 1 little move if the position of the induction heating device 5 is a reference. On the other hand, in a case where the front end section 1*b* is a reference, the position of the heated portion 1*a* moves in the direction opposite to the feeding direction of the steel pipe 1. That is, a distance between the heated portion 1*a* and the front end section 1*b* increases as the steel pipe 1 is fed in the longitudinal direction.

Next, a chuck 10 holding the front end section 1*b* of the steel pipe 1 moves in a three-dimensional direction by a drive mechanism 9, and bending moment is applied to the heated portion 1*a* of the steel pipe 1. Accordingly, the steel pipe 1 is bent.

In addition, as the drive mechanism 9, a robot arm or the like can be used.

In the present embodiment, a heating amount applied to the front end section 1*b* when the heated portion 1*a* is formed on the front end section 1*b* is greater than a heating amount applied to a portion (hereinafter, referred to as an upstream side adjacent portion) adjacent to the upstream side of the front end section 1*b* when the heated portion 1*a* is formed on the upstream side adjacent portion.

As a method for allowing the heating amount applied to the front end section 1*b* when the heated portion 1*a* is formed on the front end section 1*b* to be greater than the heating amount applied to the upstream side adjacent portion when the heated portion 1*a* is formed on the upstream side adjacent portion of the front end section 1*b*, there are a method which changes at least one of a feeding speed when the steel pipe 1 is fed in the longitudinal direction and the heating amount applied from the induction heating device 5 to the heated portion 1*a*, and a method which starts the feeding of the steel pipe 1 after supplying of high-frequency power to the induction heating device 5 is started and a predetermined time elapses.

In addition, it is possible to change the heating amount applied to the steel pipe 1 when the heated portion 1*a* is formed on the steel pipe 1 by changing high-frequency electric energy supplied to the induction heating device 5.

Aspect Example 1-1

In Aspect Example 1-1, the feeding of the steel pipe 1 is started after supplying of high-frequency power to the induction heating device 5 is started and a predetermined time elapses.

Figure 1B:
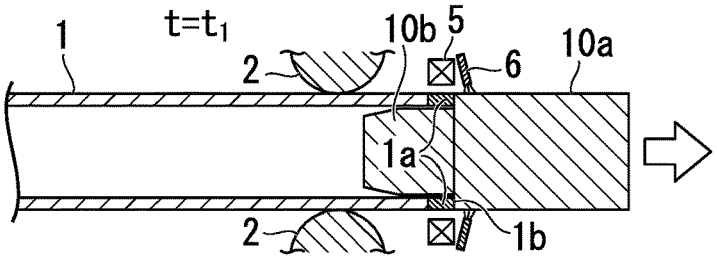
FIG. 1B is a schematic view showing the states of the steel pipe and the hot-bending apparatus for a steel pipe in a case where the vicinity of the front end section of the steel pipe is bent according to the present invention.

In the aspect example 1-1, induction heating is performed on the steel pipe 1 by supplying high-frequency power to the induction heating device 5 in a state where the feeding of the steel pipe 1 is stopped between the time $t_0$ shown in FIG. 1A to the time $t_1$ shown in FIG. 1B.

Thereafter, at the time $t_1$ when Δt seconds elapse from the time $t_0$, the feeding of the steel pipe 1 in the longitudinal direction is started.

Next, from the state of FIG. 1B, the feeding device 3 is driven, and the feeding of the steel pipe 1 in the longitudinal direction is started. For example, a feeding speed of the steel pipe 1 in the longitudinal direction may be 10 to 200 mm/second.

Figure 1C:
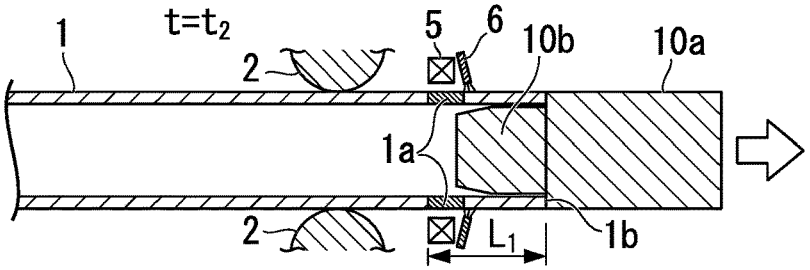
FIG. 1C is a schematic view showing the states of the steel pipe and the hot-bending apparatus for a steel pipe in a case where the vicinity of the front end section of the steel pipe is bent according to the present invention.

At the time $t_2$ shown in FIG. 1C, the heated portion 1*a* is formed at a position of a distance $L_1$ in the longitudinal direction from the front end section 1*b* of the steel pipe 1. That is, a click 10*b* of the chuck 10 comes into contact with the heated portion 1*a* from the time $t_0$ to the time $t_2$. However, the click 10 does not come into contact with the heated portion 1*a* at a time after the time $t_2$. Accordingly, by setting the time from the time $t_0$ to $t_2$ to an appropriate range, it is possible to prevent the temperature of the click 10*b* of the chuck 10 from excessively increasing.

Figure 1D:
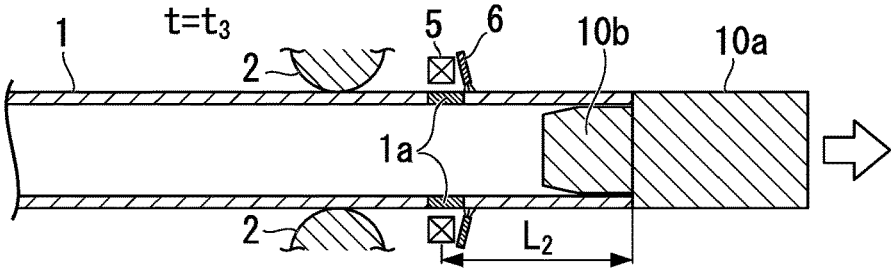
FIG. 1D is a schematic view showing the states of the steel pipe and the hot-bending apparatus for a steel pipe in a case where the vicinity of the front end section of the steel pipe is bent according to the present invention.

Next, at the time $t_3$ shown in FIG. 1D, the heated portion 1*a* is formed at a position $L_2$ of the steel pipe 1 in the longitudinal direction from the front end section 1*b* of the steel pipe 1. At the time $t_3$, the heated portion 1*a* is heated to a predetermined temperature (for example, 800° C. or higher) which is higher than an Ac3 point. Accordingly, hardness of the heated portion 1*a* formed at the position of the distance $L_2$ in the longitudinal direction from the front end section 1*b* of the steel pipe 1 is changed to hardness at which the steel pipe 1 can be bent by the drive mechanism 9, and it is possible to perform quenching by injecting a cooling medium from the cooling device 6.

Figure 1E:
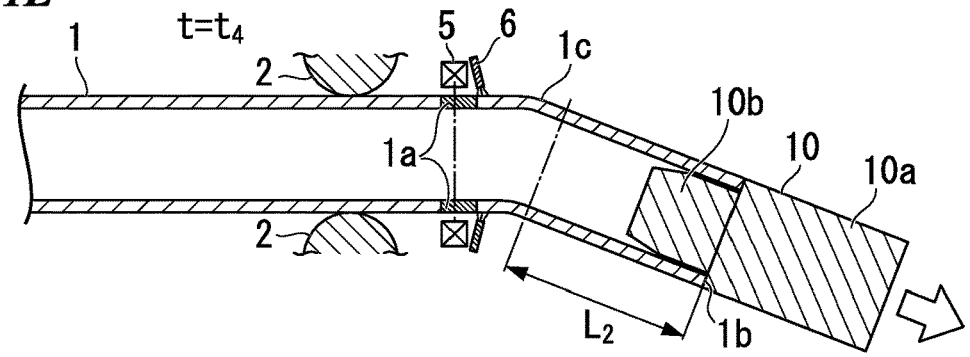
FIG. 1E is a schematic view showing the states of the steel pipe and the hot-bending apparatus for a steel pipe in a case where the vicinity of the front end section of the steel pipe is bent according to the present invention.

The bending moment is applied to the heated portion 1*a* from the time $t_3$ shown in FIG. 1D to the time $t_4$ shown in FIG. 1E, and the steel pipe 1 is bent.

It is possible to set a time Δt which is the time from the start of the induction heating of the steel pipe 1 until the start of the feeding of the steel pipe 1 based on a result of simulation or a preliminary test. As the preliminary test, a method in which bending is performed in a state where multiple thermocouples are bonded to multiple points of the steel pipe 1 in the longitudinal direction to measure the temperatures of the multiple points and temperature measurement results are obtained (temperature measurement step) is exemplified. In addition, the feeding speed of the steel pipe 1 may be determined from the temperature measurement results obtained by the preliminary test.

Preferably, the time Δt which is the time from the start of the induction heating of the steel pipe 1 until the start of the feeding of the steel pipe 1 is 2 seconds or shorter. Since the time Δt which is the time from the start of the induction heating of the steel pipe 1 until the start of the feeding of the steel pipe 1 is 2 seconds or shorter, it is possible to prevent the heated portion 1*a* of the steel pipe 1 from being heated to a temperature which is higher than a temperature at which particle-coarsening of a steel material proceeds or a temperature (for example, 1100° C.) at which toughness of the steel material decreases.

More preferably, the time Δt which is the time from the start of the induction heating of the steel pipe 1 until the start of the feeding of the steel pipe 1 is 0.3 seconds or shorter. Since the time Δt which is the time from the start of the induction heating of the steel pipe 1 until the start of the feeding of the steel pipe 1 is 0.3 seconds or shorter, it is possible to secure the non-quenching portion required for welding or drilling of the end portion of the member within a range of 30 mm or less.

Particularly preferably, the time Δt which is the time from the start of the induction heating of the steel pipe 1 until the start of the feeding of the steel pipe 1 is 0.04 seconds or shorter. Since the time Δt which is the time from the start of the induction heating of the steel pipe 1 until the start of the feeding of the steel pipe 1 is 0.04 seconds or shorter, it is possible to secure the quenching region to the end portion (range of 3 mm or less) of the member.

Here, a situation of quenching in Aspect Example 1-1 will be described with reference to FIGS. 2 to 4B. In actual, 3DQ is disposed in a state where the induction heating device 5 and the cooling device 6 are fixed, and the steel pipe 1 is fed by the feeding device 3. However, in following descriptions, for easy understanding, the position of the each device is described according to a relative position to the steel pipe 1.

Figure 2:
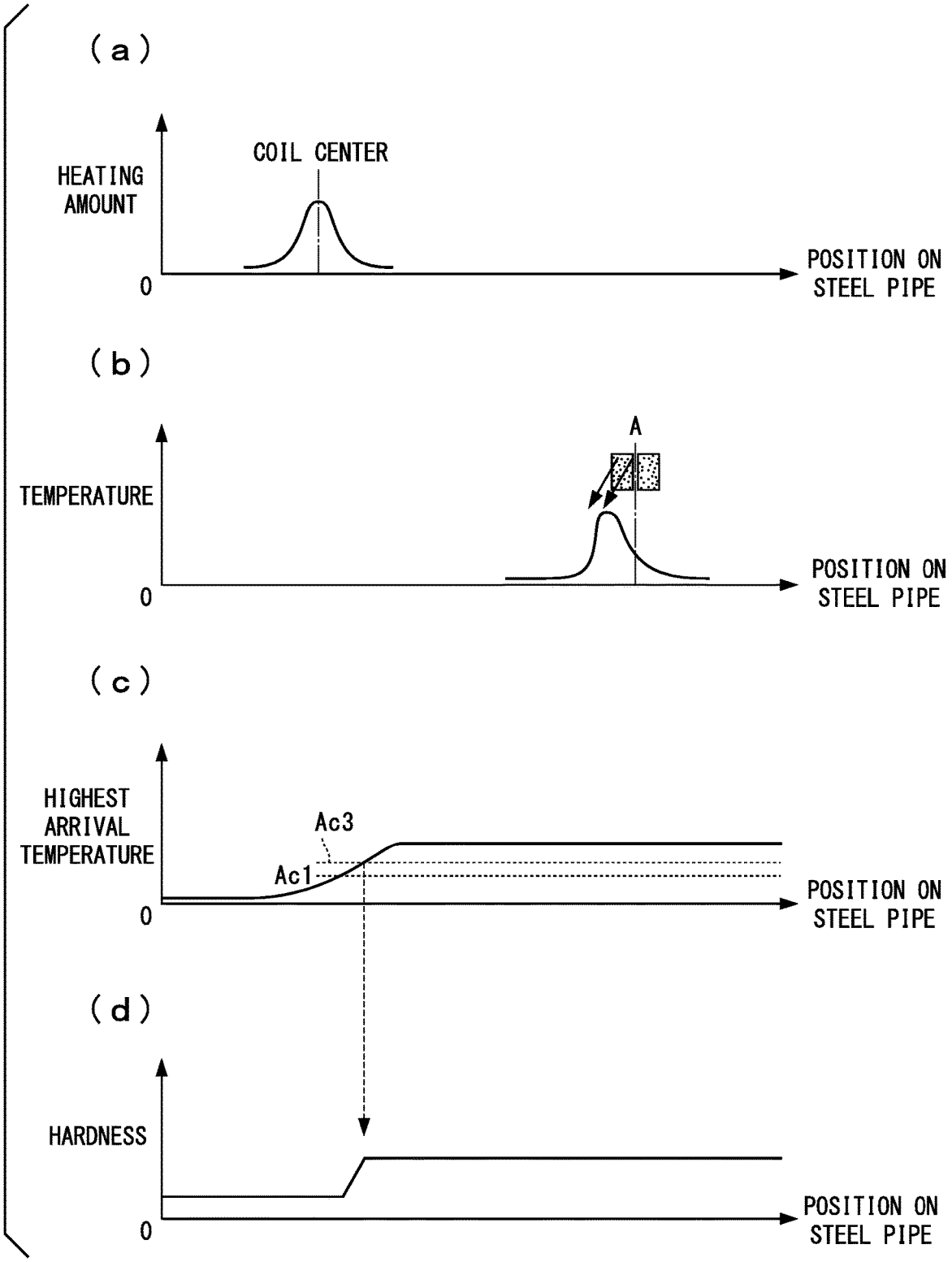
FIG. 2(*a*) is a graph which shows a heating amount applied to the steel pipe by an induction heating device with respect to the position on the steel pipe.

FIG. 2(*a*) is a graph which shows the heating amount (vertical axis) applied to the steel pipe by the induction heating device with respect to the position (horizontal axis) on the steel pipe. FIG. 2(*b*) is a graph which shows a temperature (vertical axis) on the surface of the steel pipe when the induction heating device is positioned an A point with respect to the position (horizontal axis) on the steel pipe. FIG. 2(*c*) is a graph which shows the highest arrival temperature (vertical axis) with respect to the position (horizontal axis) on the steel pipe. FIG. 2(*d*) is a graph which shows hardness (vertical axis) with respect to the position (horizontal axis) on the steel pipe.

In addition, an origin of the horizontal axis of each of FIGS. 2(*a*) to 2(*d*) is the front end section 1*b* of the steel pipe 1.

As shown in FIG. 2(*a*), the heating amount applied to the steel pipe 1 is distributed in a bell shape with the induction heating device 5 as a center. According to the feeding of the steel pipe 1, the induction heating device 5 relatively moves.

As shown in FIG. 2(*b*), the heating temperature of the steel pipe 1 by the induction heating device 5 becomes the maximum in the vicinity of a portion (hereinafter, referred to as a "cooled portion") which is cooled by the cooling medium (arrows of FIG. 2(*b*)) injected by the cooling device 6, and the cooled portion is rapidly cooled by the injected cooling medium.

In the 3DQ, since the steel pipe 1 is rapidly cooled, almost all of steel structures are transformed from austenite to martensite. Accordingly, as shown in FIG. 2(*c*), the hardness of the steel pipe 1 is changed by the highest arrival temperature.

Specifically, the hardness shown in FIG. 2(*d*) is the same hardness as that of the base metal in a portion of the steel pipe 1 in which the highest arrival temperature is lower than or equal to the Ac1 point, is the hardness of full martensite in a portion in which the highest arrival temperature is equal to or higher than the Ac3 point, and is the hardness between the base metal and the full martensite in a portion in which the highest arrival temperature is higher than the Ac1 point and lower than the Ac3 point.

Figure 3:
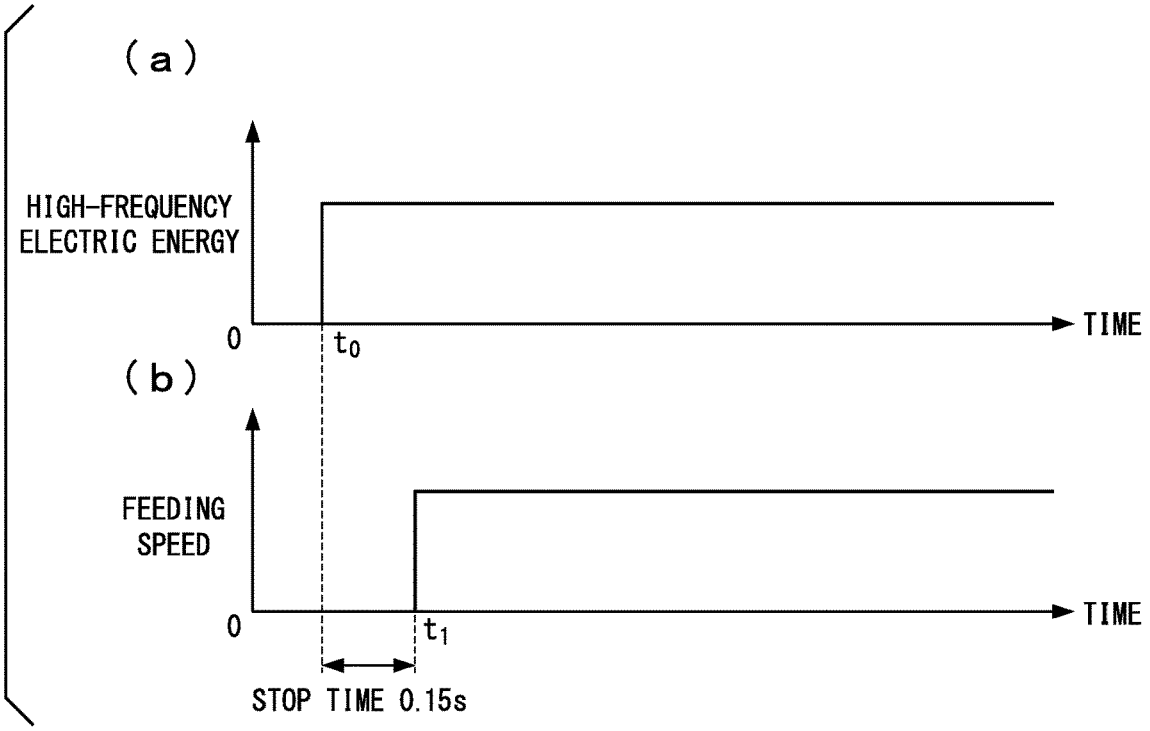
FIG. 3(*a*) is a graph which shows high-frequency electric energy supplied to an induction heating device of Aspect Example 1-1 with respect to time.
Figure 4A:
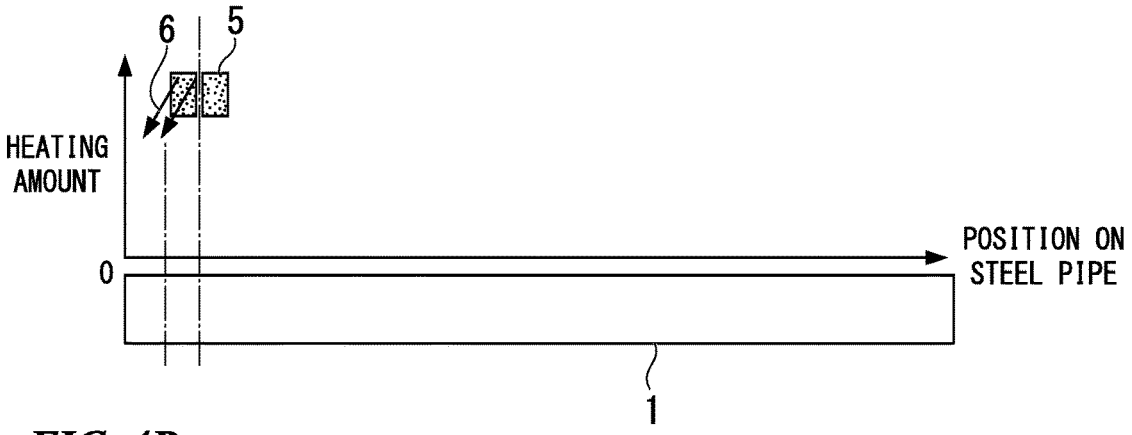
FIG. 4A is a schematic view showing a positional relationship among the steel pipe, the induction heating device, and a cooling device in Aspect Example 1-1.
Figure 4B:
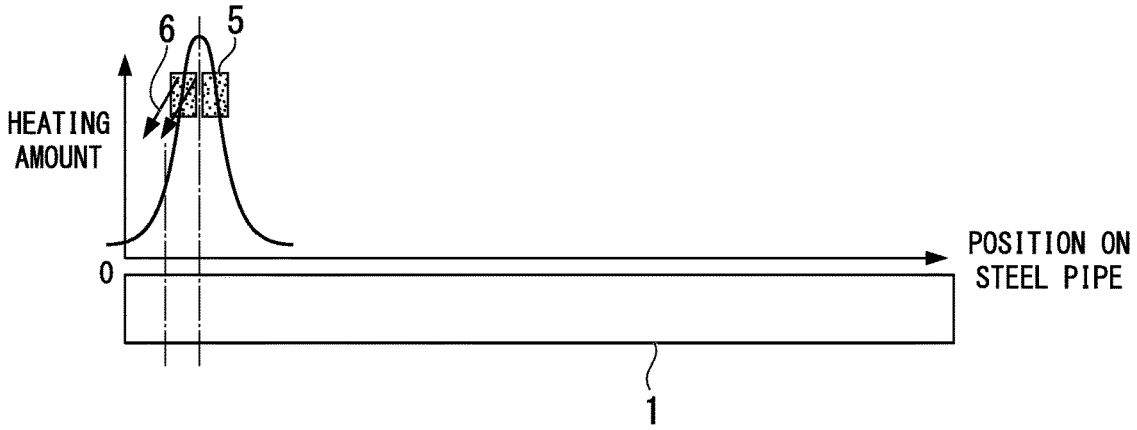
FIG. 4B is a graph which shows the heating amount applied to the steel pipe in Aspect Example 1-1 with respect to the position on the steel pipe.

FIG. 3(*a*) is a graph which shows the high-frequency electric energy (vertical axis) supplied to the induction heating device 5 of Aspect Example 1-1 with respect to time (horizontal axis). FIG. 3(*b*) is a graph which shows the feeding speed (vertical axis) of the steel pipe in Aspect Example 1-1 with respect to time (horizontal axis).

The click 10*b* is cooled by injecting the cooling medium to the click 10 of the chuck 10 from the cooling device 6 before the feeding and the induction heating of the steel pipe 1 are started. In addition, the cooling medium may be injected to the entirety of the click 10*b* or a portion of the click 10*b*.

As described below, in the present embodiment, the heating amount applied to the front end section 1*b* of the steel pipe 1 when the heated portion 1*a* is formed on the front end section 1*b* is greater than the heating amount which is applied to the upstream side adjacent portion when the heated portion 1*a* is formed on the upstream side adjacent portion. However, by cooling the click 10*b* of the chuck 10 before the feeding and the induction heating of the steel pipe 1 are started, it is possible to prevent the click 10*b* of the chuck 10 from being heated higher than 500° C. even when the heated portion 1*a* is formed on the front end section 1*b* of the steel pipe 1.

Next, high-frequency power is supplied to the induction heating device 5 in a state where the cooling medium injected from the cooling device 6 is injected to the click 10*b*, and the induction heating of the steel sheet 1 is started (time $t_0$). For Δt seconds (for 0.15 seconds in FIG. 3(*b*)) from the time $t_0$, the feeding of the steel pipe 1 is not performed, and only the induction heating and cooling are performed.

The feeding of the steel pipe 1 is started at the time $t_1$ after Δt seconds from the time $t_0$. Accordingly, the heating amount applied to the front end section 1*b* of the steel pipe 1 when the heated portion 1*a* is formed on the front end section 1*b* is greater than the heating amount which is applied to the upstream side adjacent portion when the heated portion 1*a* is formed on the upstream side adjacent portion. By allowing the heating amount applied to the front end section 1*b* of the steel pipe 1 when the heated portion 1*a* is formed on the front end section 1*b* to be greater than the heating amount which is applied to the upstream side adjacent portion when the heated portion 1*a* is formed on the upstream side adjacent portion, it is possible to bend the vicinity of the front end section 1*b* as much as possible while the non-quenching portion is formed on the front end section 1*b*.

When the bent member manufactured by the present embodiment is used as a component of an automobile or the like, in most cases, the bent member is joined to other members by welding. In the case where the bent member manufactured by the present embodiment is welded to other members, preferably, the end portion (front end section 1*b* and rear end section 1*d*) of the bent member manufactured by the present embodiment is not quenched. Since the non-quenching portion is formed on the front end section 1*b* of the bent steel pipe 1 of Aspect Example 1-1, the bent member is suitable when the bent member is welded to other members.

In addition, according to the manufacturing method for a bent member of Aspect Example 1-1, since it is possible to decrease the size of the non-quenching portion formed on the front end section 1*b*, a step of cutting an unnecessary portion of the front end section 1*b* when the bent member is manufactured is not required. Accordingly, it is possible to improve productivity and economic efficiency related to the manufacturing of the bent member.

Aspect Example 1-2

In Aspect Example 1-2, in order to cause the heating amount applied to the front end section 1*b* when the heated portion 1*a* is formed on the front end section 1*b* to be greater than the heating amount which is applied to the upstream side adjacent portion when the heated portion 1*a* is formed on the upstream side adjacent portion, the feeding speed of the steel pipe 1 is changed.

Figure 5:
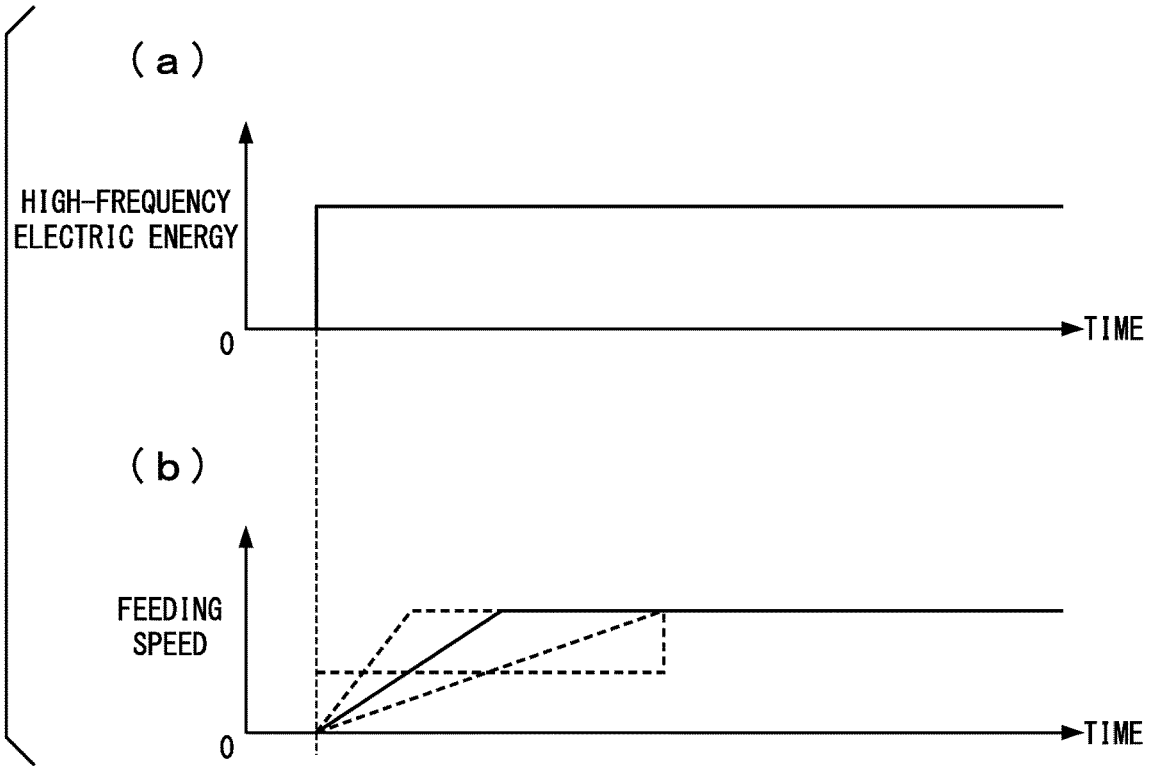
FIG. 5(*a*) is a graph which shows high-frequency electric energy supplied to an induction heating device of Aspect Example 1-2 with respect to time.

FIG. 5(*a*) is a graph which shows high-frequency electric energy (vertical axis) supplied to the induction heating device 5 of Aspect Example 1-2 with respect to time (horizontal axis). FIG. 5(*b*) is a graph which shows the feeding speed (vertical axis) of the steel pipe 1 in Aspect Example 1-2 with respect to time (horizontal axis).

In the aspect example 1-2, as shown in FIGS. 5(*a*) and 5(*b*), the induction heating of the steel pipe 1 performed by the induction heating device 5 and the feeding of the steel pipe 1 performed by the feeding device 3 are started simultaneously. As shown in FIG. 5(*a*), constant high-frequency electric energy is supplied to the induction heating device 5 from the start of the supply of the high-frequency power. On the other hand, as shown in FIG. 5(*b*), in the feeding of the steel pipe 1 performed by the feeding device 3, the feeding speed is gradually accelerated from the start of the feeding and becomes a constant feeding speed after reaching a predetermined feeding speed.

In addition, preferably, the feeding speed when the feeding is started, the feeding speed after the feeding speed is accelerated, and an acceleration ratio of the feeding speed are determined such that the heating temperature of the steel pipe 1 is not excessively increased (for example, the steel pipe 1 is not heated higher than 1100° C.). In addition, Aspect example 1-2 is the same as Aspect example 1-1 in that it is preferable to cool the click 10*b* of the chuck 10 by the cooling medium before the feeding and the induction heating are started.

Aspect Example 1-3

In Aspect Example 1-3, the heating amount applied to the front end section 1*b* of the steel pipe 1 when the heated portion 1*a* is formed on the front end section 1*b* is greater than the heating amount which is applied to the upstream side adjacent portion when the heated portion 1*a* is formed on the upstream side adjacent portion by changing high-frequency electric energy supplied to the induction heating device 5 while maintaining the feeding speed of the steel pipe 1 to be constant.

Figure 6:
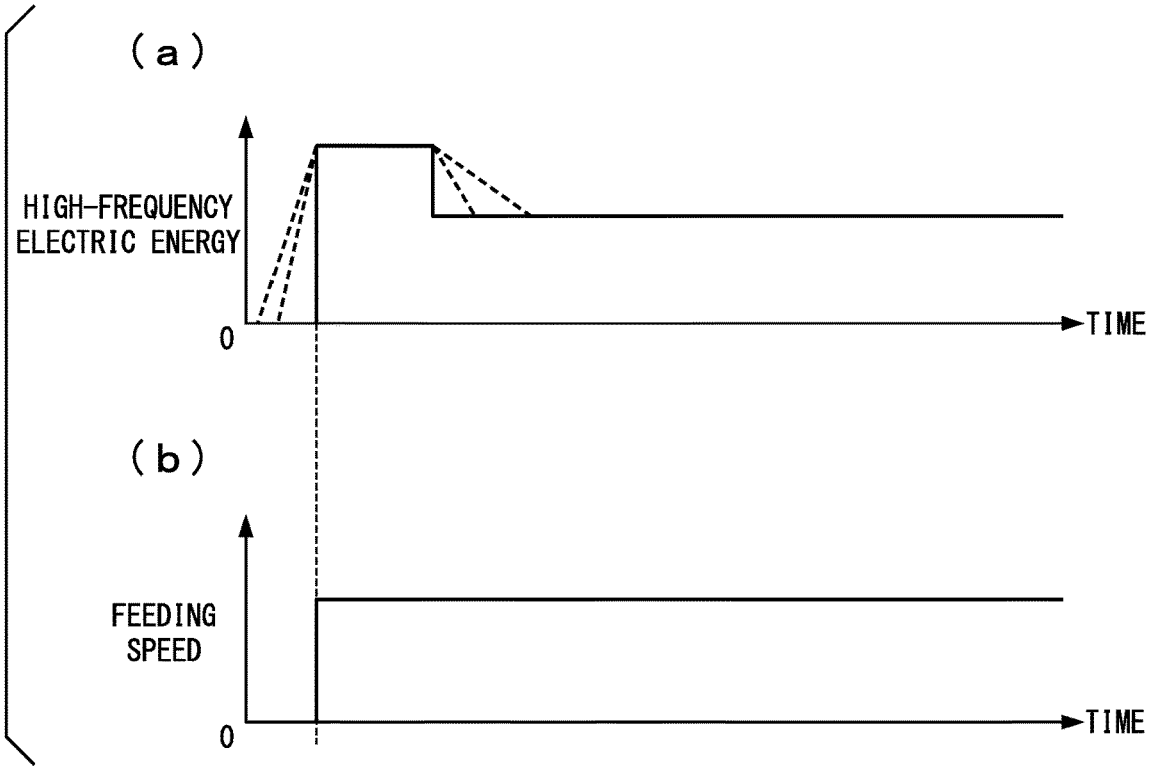
FIG. 6(*a*) is a graph which shows high-frequency electric energy supplied to an induction heating device of Aspect Example 1-3 with respect to time.

FIG. 6(*a*) is a graph which shows high-frequency electric energy (vertical axis) supplied to an induction heating device of Aspect Example 1-3 with respect to time (horizontal axis). FIG. 6(*b*) is a graph which shows a feeding speed (vertical axis) of the steel pipe in Aspect Example 1-3 with respect to time (horizontal axis).

In Aspect Example 1-3, as shown in FIGS. 6(*a*) and 6(*b*), the induction heating of the steel pipe 1 performed by the induction heating device 5 and the feeding of the steel pipe 1 performed by the feeding device 3 are started simultaneously. As shown in FIG. 6(*a*), the high-frequency electric energy supplied to the induction heating device 5 for a predetermined time from the start of the induction heating is constant. However, after the predetermined time elapses, the high-frequency electric energy supplied to the induction heating device 5 decreases. On the other hand, as shown in FIG. 6(*b*), the feeding speed of the steel pipe 1 after the start of the feeding is constant.

In addition Aspect example 1-3 is the same as Aspect example 1-1 in that it is preferable to cool the click 10*b* of the chuck 10 by the cooling medium before the feeding and the induction heating are started.

In the above-described descriptions, Aspect Examples 1-1 to 1-3 are independently embodied respectively. However, two or more of Aspect Examples 1-1 to 1-3 may be combined.

According to a previous examination, the present inventors knew that heating amounts applied to the steel pipe 1 when induction heating was performed were different from each other by 10% according to the positions of the steel pipe 1 in the circumferential direction in a case where the related art was used. Based on the knowledge obtained by the previous examination, in FIG. 9(*b*), in positions A and B, it is assumed that the applied heating amounts when the induction heating is performed are different from each other by 10%, and a relationship between the highest arrival temperature (vertical axis) and the position (horizontal axis) on the steel pipe is shown.

Figure 9:
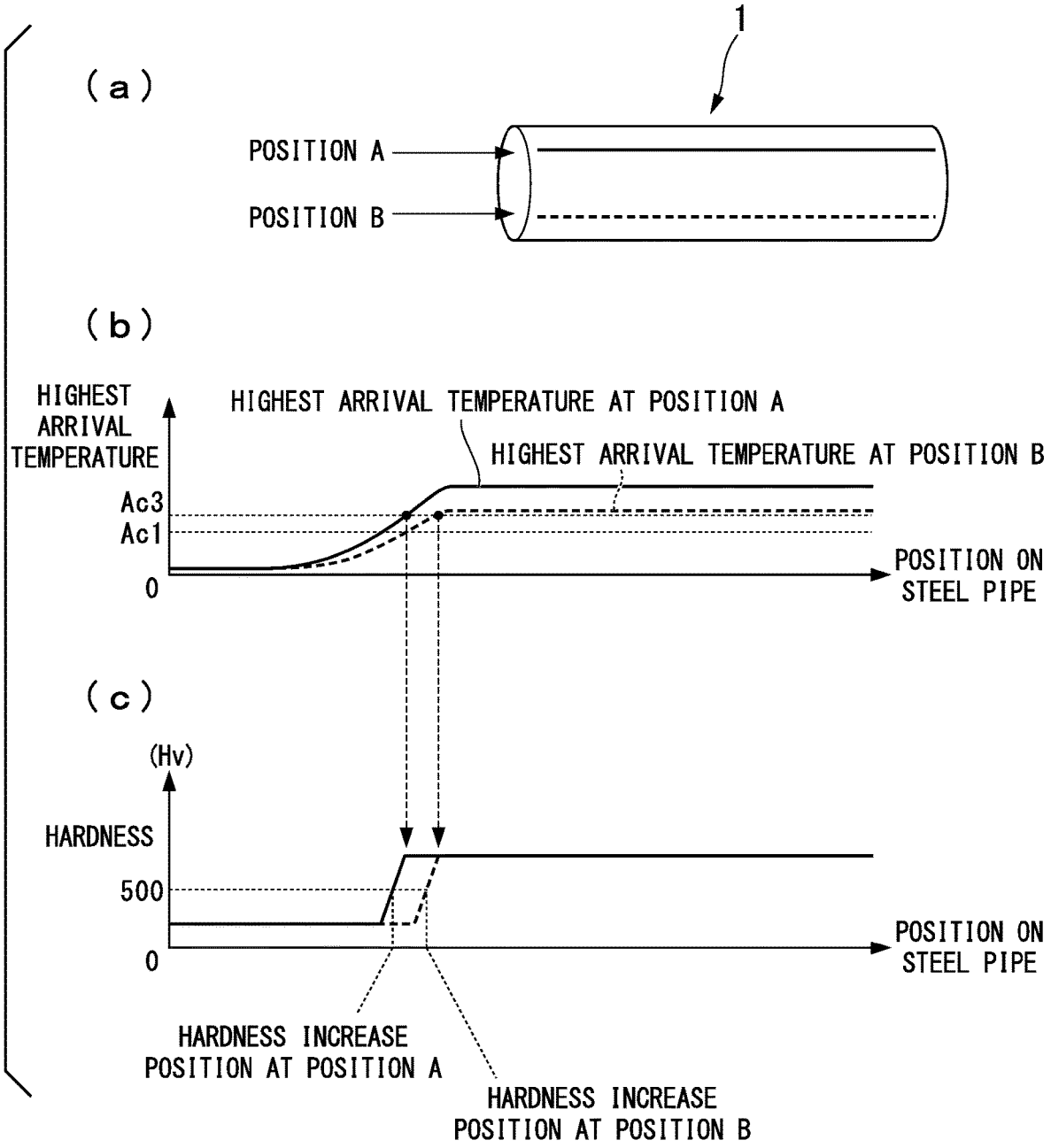
FIG. 9(*a*) is a side view of the steel pipe for explaining positions A and B.

In the case where the relationship between the highest arrival temperature (vertical axis) and the position (horizontal axis) on the steel pipe 1 is shown in FIG. 9(*b*), a relationship between hardness (vertical axis) and the position (horizontal axis) on the steel pipe 1 is shown in FIG. 9(*c*). As shown in FIG. 9(*c*), in the case where the heating amounts applied by the induction heating are different from each other in the circumferential direction of the steel pipe 1, positions of a hardness increase are different from each other according to the positions in the circumferential direction.

As described above, since the positions of a hardness increase are different from each other according to the positions of the steel pipe 1 in the circumferential direction, quality of the manufactured bent member is not uniform, which is not preferable.

According to the manufacturing method for a bent member of the present embodiment, it is possible to more uniformize the hardness of the steel pipe 1 in the circumferential direction compared to the related art.

Second Embodiment

In a manufacturing method for a bent member according to a second embodiment, by decreasing a non-quenching portion formed on the rear end section of the steel pipe as much as possible and heating a small-diameter portion of a chuck holding the rear end section of the steel pipe such that the heated temperature is not higher than 500° C. when a rear end section of a steel pipe is bent, productivity and economic efficiency in the manufacturing of the bent member are improved, and fatigue fracture of the small-diameter portion of the chuck holding the rear end section of the steel pipe is prevented.

FIGS. 22A to 22D are schematic views showing a state where the vicinity of a rear end section 1*d* of the steel pipe 1 is bent using the related art.

Figure 22A:
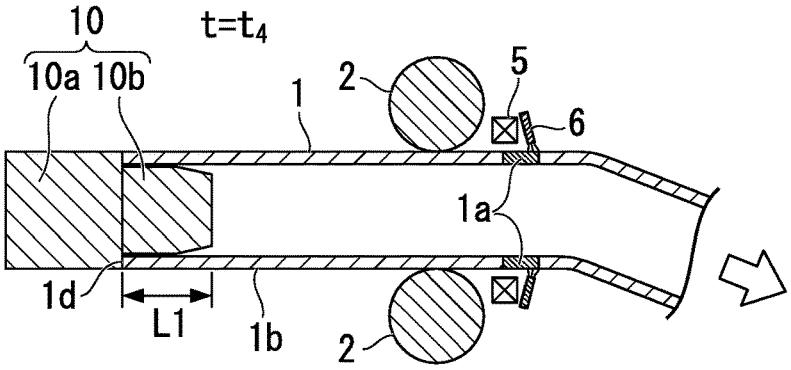
FIG. 22A is a schematic view showing a state where the vicinity of the rear end section of the steel pipe is bent using the related art.

FIG. 22A shows a state at a time $t_4$ when induction heating performed by the induction heating device 5 and the feeding of the steel pipe 1 performed by the feeding device 3 are performed. At the time $t_4$, the rear end section 1*d* of the steel pipe 1 is positioned at a position separated from the induction heating device 5 and the cooling device 6.

Figure 22B:
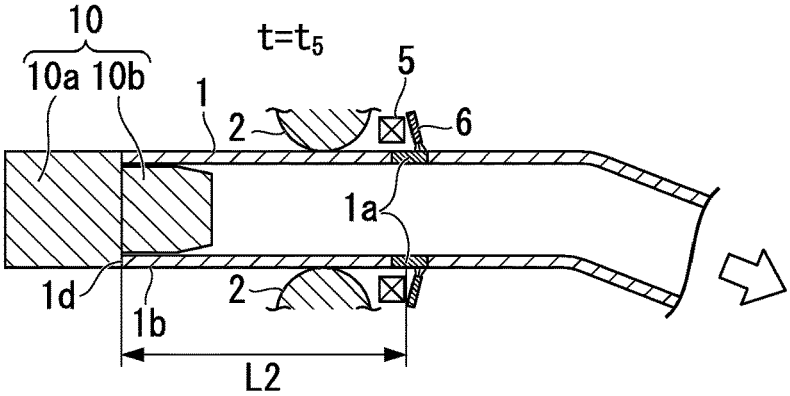
FIG. 22B is a schematic view showing the state where the vicinity of the rear end section of the steel pipe is bent using the related art.

The rear end section 1*d* of the steel pipe 1 gradually approaches the induction heating device 5 and the cooling device 6 as it proceeds from the time $t_4$ shown in FIG. 22A to a time $t_5$ shown in FIG. 22B. At the time $t_5$, since the induction heating to the steel pipe 1 is performed, the heated portion 1*a* is formed on the steel pipe 1.

Figure 22C:
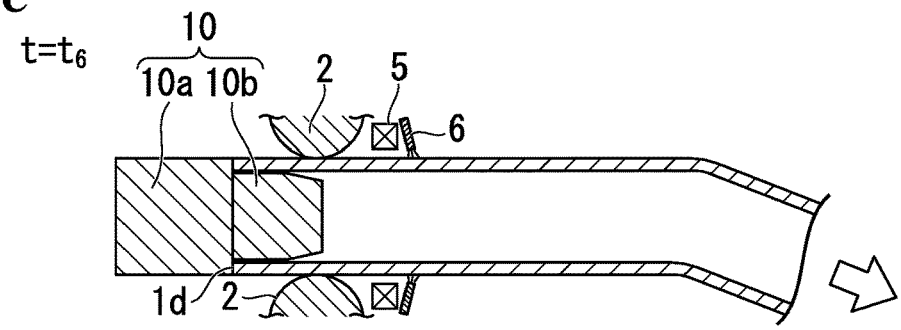
FIG. 22C is a schematic view showing the state where the vicinity of the rear end section of the steel pipe is bent using the related art.
Figure 22D:
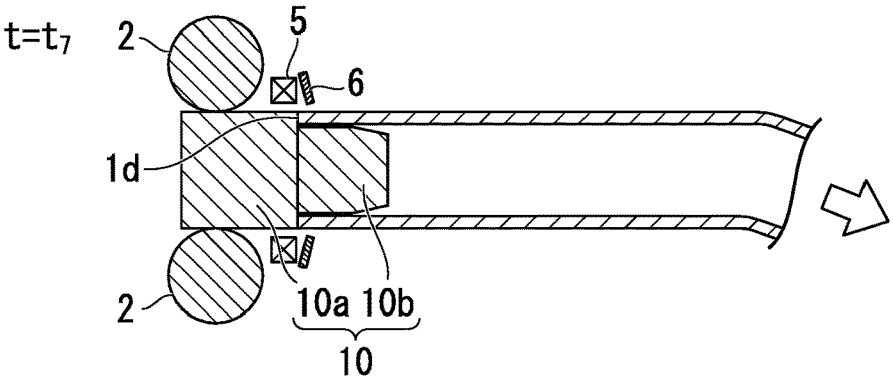
FIG. 22D is a schematic view showing the state where the vicinity of the rear end section of the steel pipe is bent using the related art.

The induction heating to the steel pipe 1 is stopped immediately before it reaches a time $t_7$ shown in FIG. 22D from a time $t_6$ shown in FIG. 22C.

Thereafter, feeding and cooling to the steel pipe 1 are performed, and bending to the steel pipe 1 is finished at the time $t_7$ shown in FIG. 22D.

However, the present inventor found that the rear end section 1*d* of the steel pipe 1 was heated higher than 1100° C. if the vicinity of the rear end section 1*d* of the steel pipe 1 was bent by the method shown in FIGS. 22A to 22D.

In the case where the rear end section 1*d* of the steel pipe 1 is heated higher than 1100° C., particle-coarsening of metallographic structures is generated in the heated portion 1*a* and workability decreases, which is not preferable.

In addition, in the case where the rear end section 1*d* of the steel pipe 1 is heated higher than 1100° C., the click 10*b* of the chuck 10 holding the rear end section 1*d* of the steel pipe 1 is likely to be heated higher than 500° C. If the click 10*b* of the chuck 10 is heated higher than 500° C., the fatigue fracture of the chuck 10 is likely to occur, which is not preferable.

Moreover, in the case where the rear end section 1*d* of the steel pipe 1 is heated higher than 1100° C., the rear end section 1*d* of the steel pipe 1 is softened and the rear end section 1*d* of the steel pipe 1 is likely to be distorted by a holding force of the chuck 10, which is not preferable.

In order to not heat the rear end section 1*d* of the steel pipe 1 higher than 1100° C., a method is configured, which stops the induction heating performed by the induction heating device 5 at a position separated from the rear end section 1*d* of the steel pipe 1 when the bending to the steel pipe 1 is performed. However, in the case where the induction heating performed by the induction heating device 5 is stopped at a position separated from the rear end section 1*d* of the steel pipe 1 when the bending to the steel pipe 1 is performed, the non-quenching portion formed on the rear end section 1*d* of the steel pipe 1 increases, which is not preferable from the viewpoint of productivity and economic efficiency.

Accordingly, a manufacturing method for a bent member is required, by which the size of the non-quenching portion formed on the rear end section 1*d* of the steel pipe 1 decreases as much as possible, and the rear end section 1*d* of the steel pipe 1 is not heated higher than 1100° C.

Figure 15:
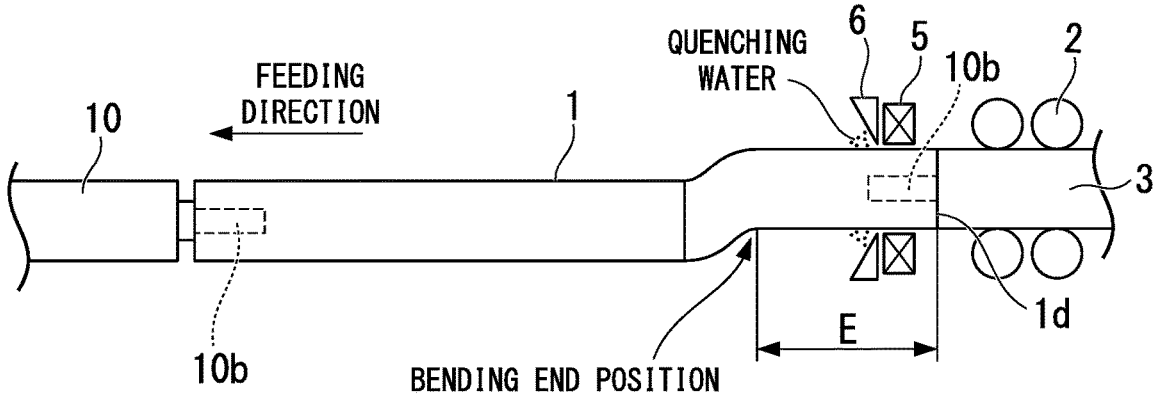
FIG. 15 is a schematic view showing a steel pipe and a hot-bending apparatus for a steel pipe in a case where the vicinity of the rear end section of the steel pipe is bent according to 3DQ.

FIG. 15 is a schematic view showing the steel pipe 1 and the hot-bending apparatus 0 for a steel pipe when the vicinity of the rear end section 1*d* of the steel pipe 1 is bent according to the 3DQ. A distance E of FIG. 15 is the distance from the downstream end (hereinafter, referred to as a bending end position) of the portion in which the bending is performed on the steel pipe 1 to the rear end section 1*d* of the steel pipe 1.

Figure 16:
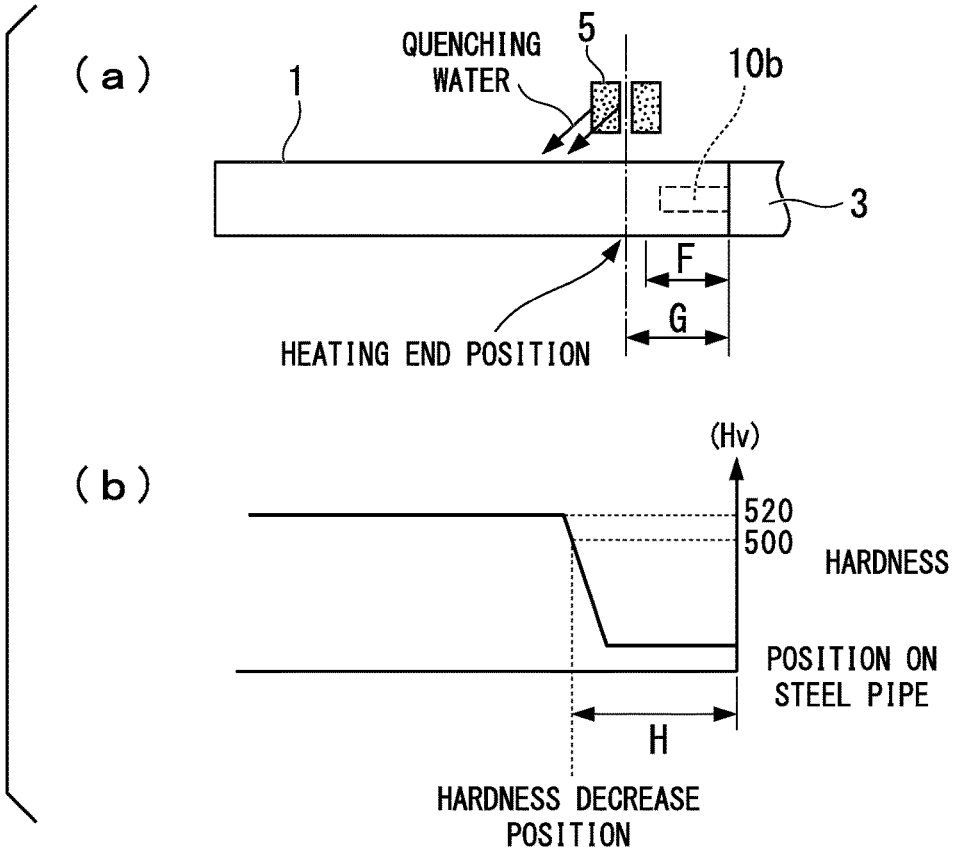
FIG. 16(*a*) is a schematic view showing a positional relationship between a steel pipe and a hot-bending apparatus in the vicinity of the rear end section of the steel pipe.

FIG. 16(*a*) is a schematic view showing a positional relationship between the steel pipe 1 and the hot-bending apparatus 0 for a steel pipe in the vicinity of the rear end section 1*d* of the steel pipe 1. A distance F in FIG. 16(*a*) is the contact distance of the click 10*b* of the chuck 10 and the inner surface of the rear end section 1*d* of the steel pipe 1. A distance G in FIG. 16(*a*) is the distance from the center portion (hereinafter, referred to as a heating end position) of the heated portion 1*a* in the longitudinal direction when the induction heating to the steel pipe 1 is finished to the rear end section 1*d* of the steel pipe 1.

FIG. 16(*b*) is a graph which shows a relationship between hardness (vertical axis) and the position (horizontal axis) on the steel pipe 1 in the vicinity of the rear end section 1*d* of the steel pipe 1. A distance H in FIG. 16(*b*) is the distance from the downstream end (hereinafter, referred to as a hardness decrease position) of the portion in which hardness is 500 Hv in the steel pipe 1 to the rear end section 1*d* of the steel pipe 1.

In a case where the distance H is long, the non-quenching portion formed on the rear end section 1*d* of the steel pipe 1 is increased. In the case where the non-quenching portion increases, since a step of cutting the non-quenching portion may be required, productivity and economic efficiency in the manufacturing of the bent member decrease.

In order to decrease the distance H, a method which decreases the distance G is considered. However, if the distance G decreases, the rear end section 1*d* of the steel pipe 1 may be heated higher than 1100° C. In the case where the rear end section 1*d* of the steel pipe 1 is heated higher than 1100° C., particle-coarsening of metallographic structures is generated in the heated portion 1*a* and workability decreases, which is not preferable.

In addition, in the case where the rear end section 1*d* of the steel pipe 1 is heated higher than 1100° C., the click 10*b* of the chuck 10 holding the rear end section 1*d* of the steel pipe 1 is likely to be heated higher than 500° C. If the click 10*b* of the chuck 10 is heated higher than 500° C., the fatigue fracture of the chuck 10 is likely to occur, which is not preferable.

Moreover, in the case where the rear end section 1*d* of the steel pipe 1 is heated higher than 1100° C., the rear end section 1*d* of the steel pipe 1 is softened and the rear end section 1*d* of the steel pipe 1 is likely to be distorted by the holding force of the chuck 10, which is not preferable.

Figure 17:
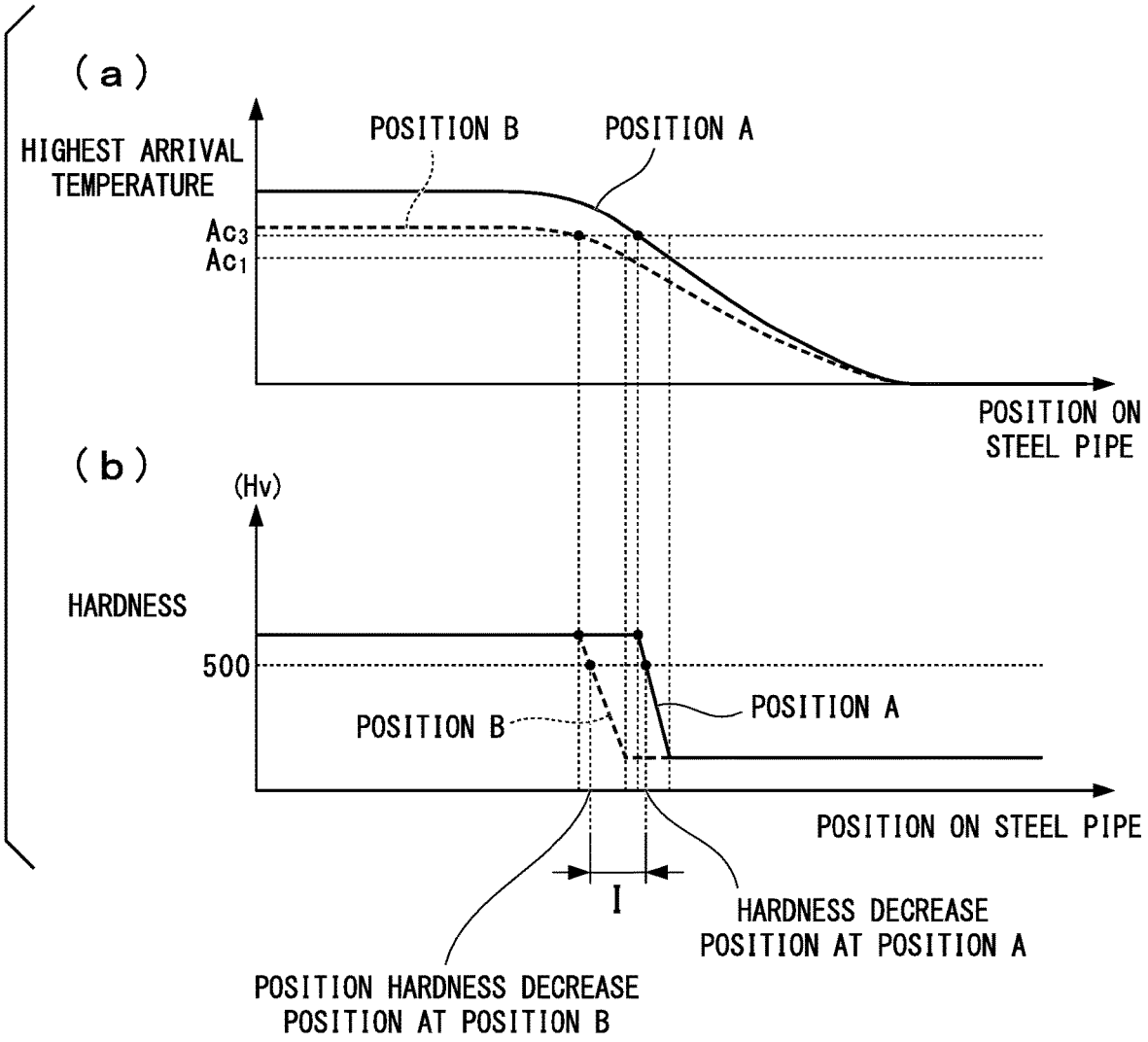
FIG. 17(*a*) is a simulation result which shows a relationship between the highest arrival temperature and the position on the steel pipe when it is assumed that the heating amount applied to the position A shown in FIG. 9(*a*) is greater by 10% than the heating amount applied to the position B when the vicinity of the rear end section of the steel pipe is bent.

FIG. 17(*a*) is a simulation result which shows a relationship between the highest arrival temperature (vertical axis) and the position (horizontal axis) on the steel pipe 1 when it is assumed that the heating amount applied to the position A shown in FIG. 9(*a*) is greater by 10% than the heating amount applied to the position B when the vicinity of the rear end section 1*d* of the steel pipe 1 is bent. FIG. 17(*b*) is a simulation result which shows a relationship between hardness (vertical axis) and the position (horizontal axis) on the steel pipe 1 when it is assumed that the heating amount applied to the position A shown in FIG. 9(*a*) is greater by 10% than the heating amount applied to the position B when the vicinity of the rear end section 1*d* of the steel pipe 1 is bent.

As shown in FIG. 17(*b*), in the case where it is assumed that the heating amount applied to the position A shown in FIG. 9(*a*) is greater by 10% than the heating amount applied to the position B, the hardness decrease portion at the position A and the hardness decrease position at the position B are separated from each other by a distance I in the longitudinal direction of the steel pipe 1. In order to improve productivity and economic efficiency in the manufacturing of the bent member, it is preferable to shorten the distance I as much as possible. In order to shorten the distance I, it is necessary to uniformize the heating amount applied to the steel pipe 1 in the circumferential direction.

Figure 18:
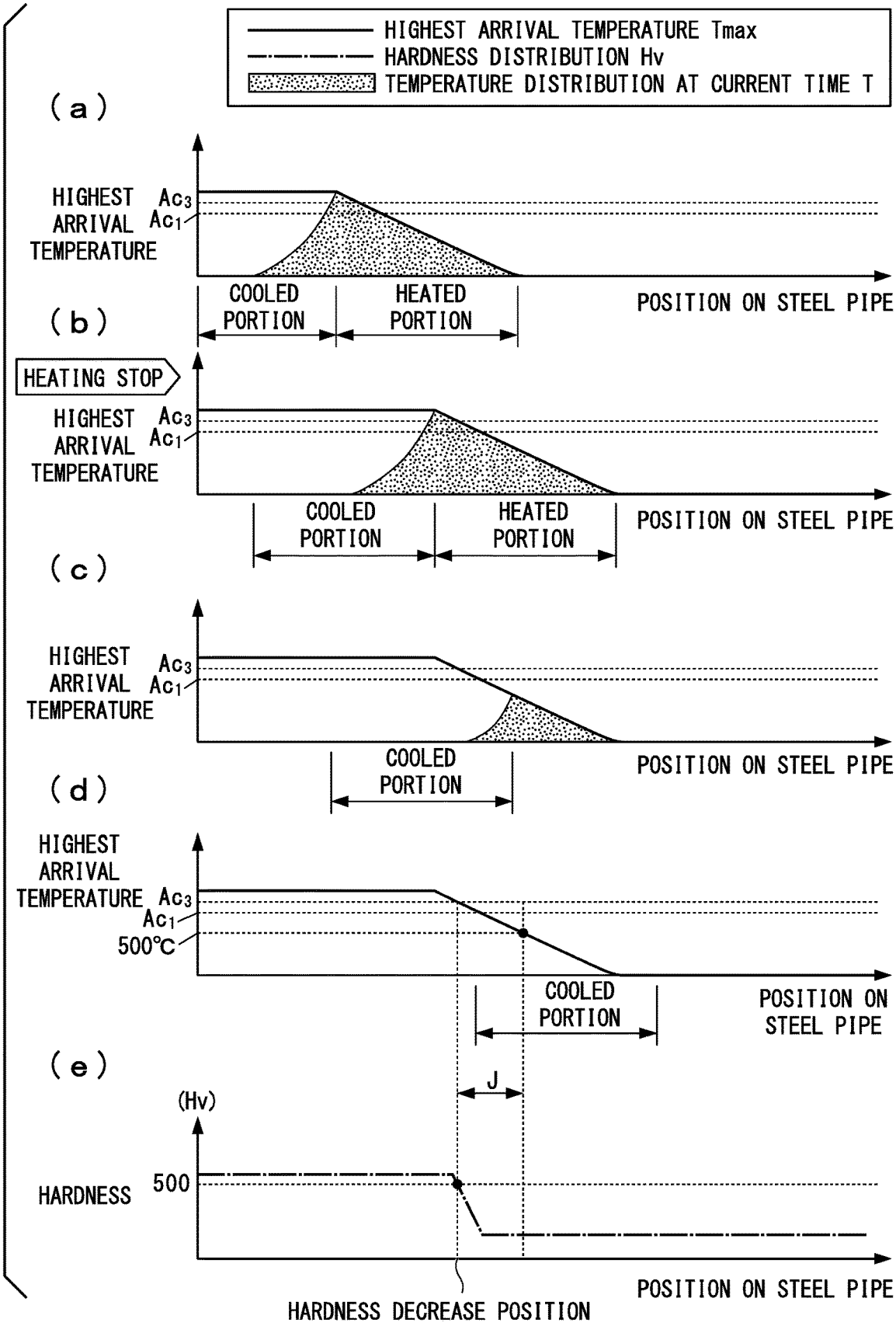
FIGS. 18(*a*) to 18(*d*) are graphs which show the highest arrival temperature and a temperature distribution at a current time with respect to the positions on the steel pipe in a case where the vicinity of the rear end section of the steel pipe is bent using the related art.

FIGS. 18(*a*) to 18(*d*) are graphs which show the highest arrival temperature and a temperature distribution (vertical axis) at a current time with respect to the positions (horizontal axis) on the steel pipe in a case where the vicinity of the rear end section 1*d* of the steel pipe 1 is bent using the related art. In addition, an origin of the horizontal axis in FIGS. 18(*a*) to 18(*d*) is an arbitrary position on the steel pipe 1.

In addition, in FIGS. 18(*a*) to 18(*d*), the portion of the steel pipe 1 which is induction-heated by the induction heating device 5 is represented as the heated portion, and the portion of the steel pipe 1 which is cooled by injecting the cooling medium from the cooling device 6 is represented as the cooled portion.

At the time shown in FIG. 18(*a*), the induction heating of the steel pipe 1 performed by the induction heating device 5, the cooling of the steel pipe 1 performed by injecting the cooling medium from the cooling device 6, and the feeding of the steel pipe 1 performed by the feeding device 3 are performed.

FIG. 18(*b*) shows a state where the induction heating of the steel pipe 1 performed by the induction heating device 5, the cooling of the steel pipe 1 performed by injecting the cooling medium from the cooling device 6, and the feeding of the steel pipe 1 performed by the feeding device 3 are continuously performed from the state shown in FIG. 18(*a*). At the time shown in FIG. 18(*b*), the induction heating of the steel pipe 1 performed by the induction heating device 5 is stopped.

FIG. 18(*c*) shows a state where the induction heating of the steel pipe 1 performed by the induction heating device 5 is stopped and the cooling and the feeding of the steel pipe 1 are performed from the state shown in FIG. 18(*b*). At the time shown in FIG. 18(*c*), a portion having a temperature higher than the Ac1 point does not exist.

FIG. 18(*d*) shows a state where the cooling of the steel pipe 1 performed by injecting the cooling medium from the cooling device 6 and the feeding of the steel pipe 1 performed by the feeding device 3 are performed from the state shown in FIG. 18(*c*). At the time shown in FIG. 18(*d*), the bending to the steel pipe 1 is finished.

FIG. 18(*e*) is a graph which shows a relationship between the hardness (vertical axis) of the steel pipe 1 and the position (horizontal axis) on the steel pipe 1 after the bending shown in FIGS. 18(*a*) to 18(*d*) is performed. In addition, the origin of the horizontal axis in FIG. 18(*e*) is an arbitrary position on the steel pipe 1.

A distance J shown in FIG. 18(*e*) indicates the distance from the hardness decrease position to a position at which the highest arrival temperature is 500° C. in the vicinity of the rear end section 1*d* of the steel pipe 1. In order to allow the heating temperature of the click 10*b* of the chuck 10 holding the rear end section 1*d* of the steel pipe 1 to be 500° C. or lower, preferably, the heating temperature of the rear end section 1*d* of the steel pipe 1 held by the click 10*b* of the chuck 10 is 500° C. or lower. In addition, in order to improve productivity and economic efficiency in the manufacturing of the bent member, preferably, the hardness decrease position approaches the rear end section 1*d* of the steel pipe 1.

From the above-described reasons, in order prevent the fatigue fracture of the chuck 10 holding the rear end section 1*d* of the steel pipe 1 and improve productivity and economic efficiency in the manufacturing of the bent member, it is preferable to shorten the distance J.

In the present embodiment, the heating amount applied to the rear end section 1*d* when the heated portion 1*a* is formed on the rear end section 1*d* is greater than the heating amount applied to a portion (hereinafter, referred to as a downstream side adjacent portion) adjacent to the downstream side of the rear end section 1*d* when the heated portion 1*a* is formed on the downstream side adjacent portion.

A method for allowing the heating amount applied to the rear end section 1*d* when the heated portion 1*a* is formed on the rear end section 1*d* to be greater than the heating amount applied to the upstream side adjacent portion of the rear end section 1*d* when the heated portion 1*a* is formed on the upstream side adjacent portion, there is a method which stops only the feeding from the state where the induction heating, the cooling, and the feeding are performed on the rear end section 1*d* of the steel pipe 1, stops supply of high-frequency power to the induction heating device 5 after a predetermined time elapses, and stops the induction heating of the steel pipe 1.

In addition, as another method, there is a method which decelerated the feeding speed of the steel pipe 1 from the state where the induction heating, the cooling, and the feeding are performed on the rear end section 1*d* of the steel pipe 1, stops supply of high-frequency power to the induction heating device 5 after a predetermined time elapses, and stops the induction heating of the steel pipe 1.

Moreover, as another method, there is a method which increases high-frequency electric energy supplied to the induction heating device 5 from the state where the induction heating, the cooling, and the feeding are performed on the rear end section 1*d* of the steel pipe 1, stops supply of high-frequency power to the induction heating device 5 after a predetermined time elapses, and stops the induction heating of the steel pipe 1.

Figure 19:
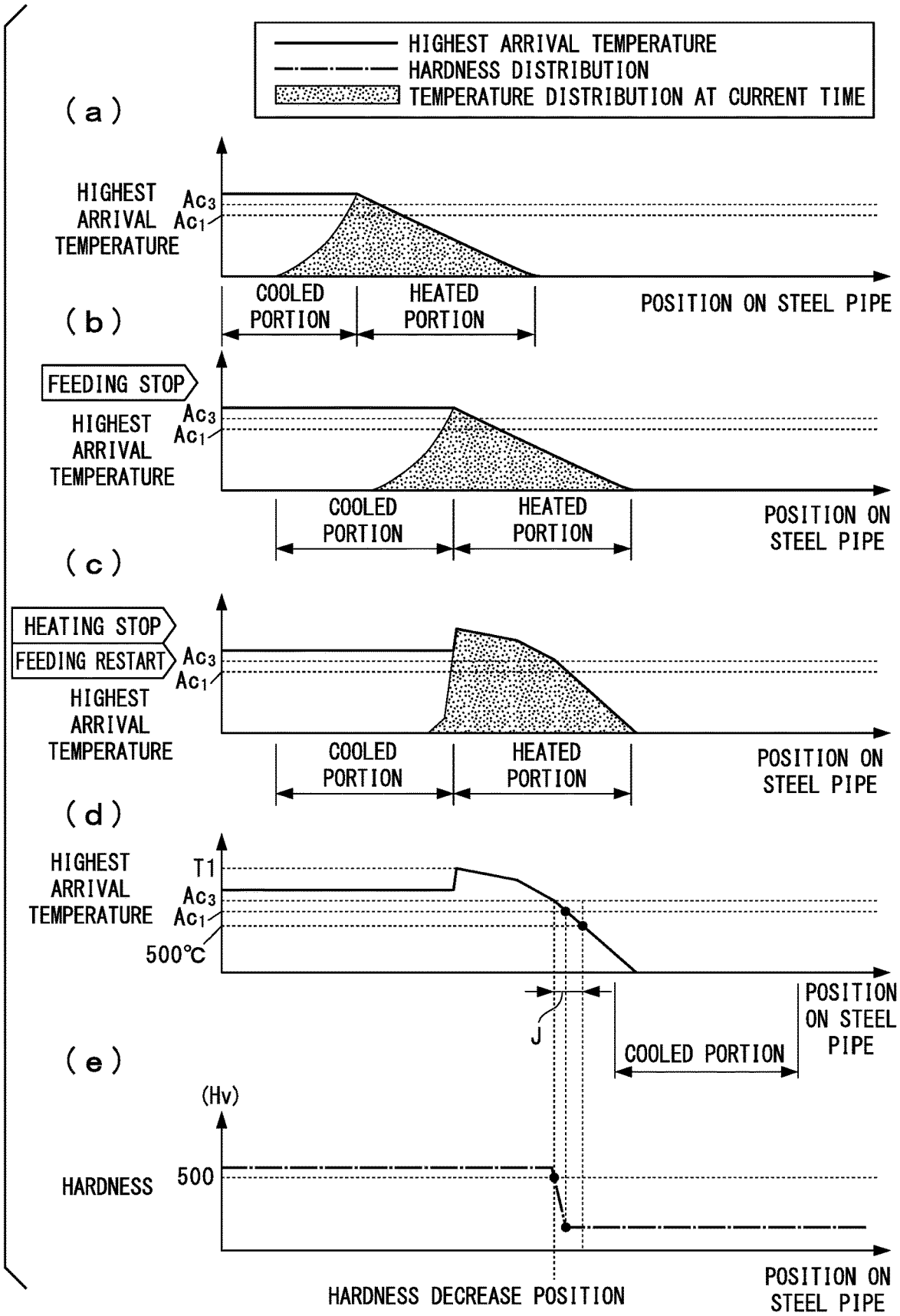
FIGS. 19(*a*) to 19(*d*) are graphs which show the highest arrival temperature and a temperature distribution at a current time with respect to the positions on the steel pipe in a case where the rear end section of the steel pipe is bent using the present invention.

FIGS. 19(*a*) to 19(*d*) are graphs which show the highest arrival temperature and the temperature distribution (vertical axis) at a current time with respect to the positions (horizontal axis) on the steel pipe 1 in a case where the rear end section 1*d* of the steel pipe 1 is bent using the present embodiment. In addition, the origin of the horizontal axis in FIGS. 19(*a*) to 19(*d*) is an arbitrary position on the steel pipe 1.

At the time shown in FIG. 19(*a*), the induction heating of the steel pipe 1 performed by the induction heating device 5, the cooling of the steel pipe 1 performed by injecting the cooling medium from the cooling device 6, and the feeding of the steel pipe 1 performed by the feeding device 3 are performed.

FIG. 19(*b*) shows a state where the induction heating of the steel pipe 1 performed by the induction heating device 5, the cooling of the steel pipe 1 performed by injecting the cooling medium from the cooling device 6, and the feeding of the steel pipe 1 performed by the feeding device 3 are continuously performed from the state shown in FIG. 19(*a*). At the time shown in FIG. 19(*b*), the feeding of the steel pipe 1 performed by the feeding device 3 is stopped, and the induction heating of the steel pipe 1 performed by the induction heating device 5 and the cooling of the steel pipe 1 performed by injecting the cooling medium from the cooling device 6 are continuously performed.

FIG. 19(*c*) shows a state where the induction heating of the steel pipe 1 performed by the induction heating device 5 and the cooling of the steel pipe 1 performed by injecting the cooling medium from the cooling device 6 are continuously performed from the state shown in FIG. 19(*b*). At the time shown in FIG. 19(*c*), the stopped feeding of the steel pipe 1 due to the stopped feeding device 3 is released, and the induction heating of the steel pipe 1 performed by the induction heating device 5 is stopped. In addition, the cooling of the steel pipe 1 performed by injecting the cooling medium from the cooling device 6 is continuously performed.

FIG. 19(*d*) shows a state where the feeding of the steel pipe 1 performed by the feeding device 3 and the cooling of the steel pipe 1 performed by injecting the cooling medium from the cooling device 6 are performed from the state shown in FIG. 19(*c*). As shown in FIG. 19(*d*), in a case where the rear end section 1*d* of the steel pipe 1 is bent according to the present embodiment, a portion (a portion in which the highest arrival temperature is $T_1$) which has a highest arrival temperature which is higher than those of other portions is generated.

FIG. 19(*e*) is a graph which shows a relationship between the hardness (vertical axis) of the steel pipe 1 and the position (horizontal axis) on the steel pipe 1 after the bending shown in FIGS. 19(*a*) to 19(*d*) is performed. In addition, the origin of the horizontal axis in FIG. 19(*e*) is an arbitrary position on the steel pipe 1. Compared to the distance J (refer to FIG. 18(*e*)) from the hardness decrease position to the position at which the highest arrival temperature is 500° C. when the rear end section 1*d* of the steel pipe 1 is bent according to the related art and the distance J (refer to FIG. 19(*e*)) when the rear end section 1*d* of the steel pipe 1 is bent according to the manufacturing method for a bent member of the present embodiment, it is found that the distance J when the rear end section 1*d* of the steel pipe 1 is bent according to the manufacturing method for a bent member of the present embodiment is shorter than the distance J of the related art.

As described above, since the distance J in the case where the rear end section 1*d* of the steel pipe 1 is bent according to the manufacturing method for a bent member of the present embodiment can be shorter than the distance J of the related art, it is possible to prevent the fatigue fracture of the chuck 10 holding the rear end section 1*d* of the steel pipe 1 and to improve productivity and economic efficiency in the manufacturing of the bent member.

Third Embodiment

A manufacturing method for a bent member according to a third embodiment is a method which forms a first heated portion at a position except for the front end section and the rear end section of the steel pipe, forms a second heated portion at a position on the upstream side of the first heated portion, and forms a non-quenching portion between the first heated portion and the second heated portion.

According to the manufacturing method for a bent member of the third embodiment, in a case where the non-quenching portion of the manufactured bent member is cut to obtain multiple bent members, since the hardness of the non-quenching portion which is the cut portion is low, it is possible to easily cut the bent member. In addition, in order to more easily cut the cut portion, preferably, the hardness of the cut portion is the same as the hardness of the base metal.

In addition, according to the manufacturing method for a bent member of the third embodiment, since the bending can be performed in the vicinity of the non-quenching portion which is the cut portion, an unnecessary portion is not generated, and it is possible to improve economic efficiency.

In the case where the bent member is cut to obtain multiple bent members, when the end portion of the cut bent member is used as a component of an automobile or the like, the end portion is joined to the other members by welding or the like in most cases. In the case where the cut bent member is welded to other members, preferably, the end portion of the cut bent member is not quenched. Since the non-quenching portion is formed in the cut portion of the bent member manufactured according to the third embodiment, the bent member is suitably used to be welded to the other members.

In order to allow the hardness of the portion between the first heated portion and the second heated portion to have the same hardness as that of the base metal and form the non-quenching portion having a short width dimension as much as possible, since the induction heating of the steel pipe 1 is temporarily stopped from the state where the feeding and the induction heating of the steel pipe 1 are performed, preferably, supplying of high-frequency power to the induction heating device 5 is temporarily stopped and thereafter, the supplying of the high-frequency power to the induction heating device 5 is started.

However, the present inventors found that it was difficult to allow the hardness of the portion to have the same hardness as that of the base metal and to form the non-quenching portion having a short width dimension as much as possible by the above-described method.

Figure 29:
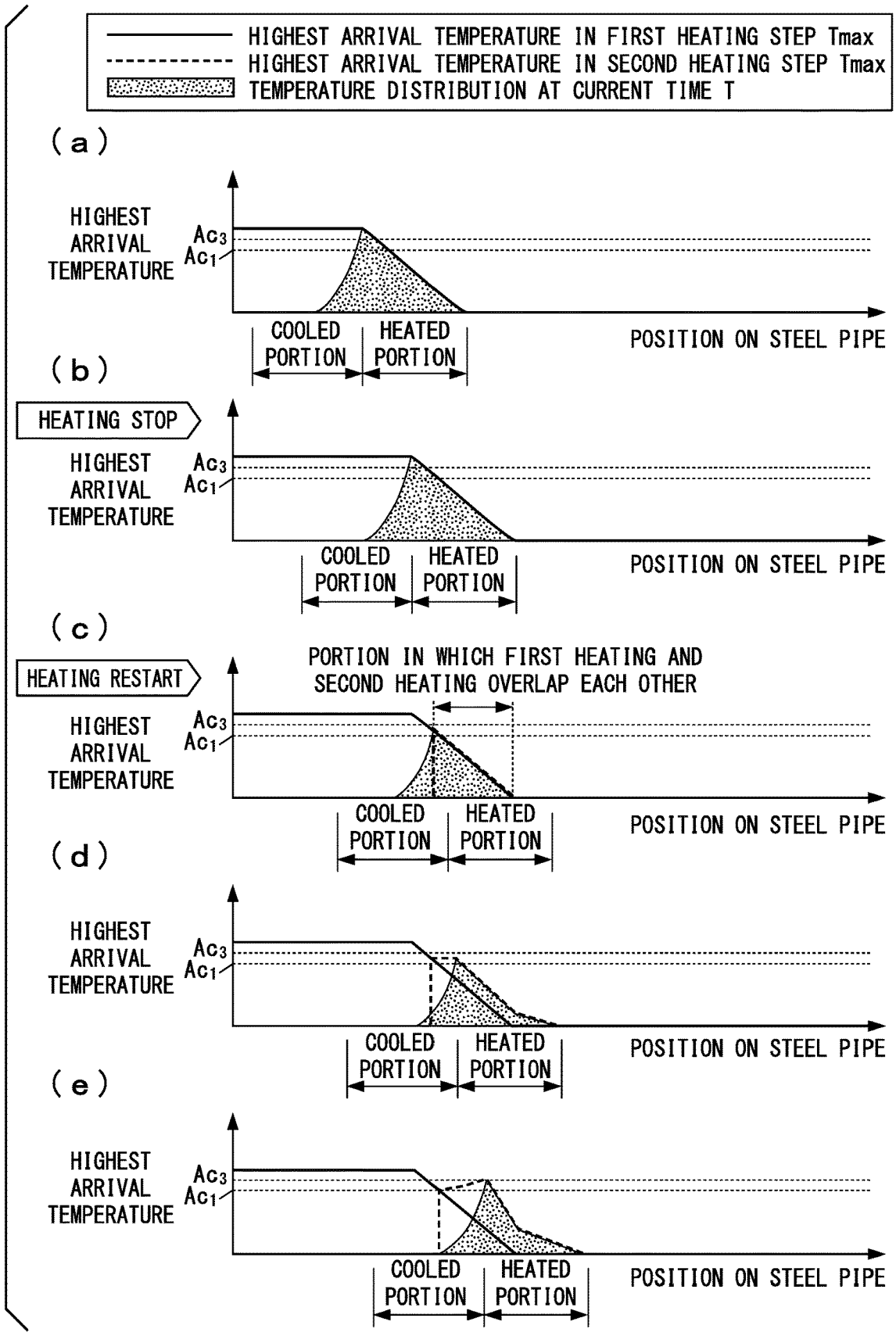
FIGS. 29(*a*) to 29(*e*) are graphs which show the highest arrival temperature and the temperature distribution at a current time with respect to the positions on the steel pipe in a case where portions except for the front end section and the rear end section of the steel pipe are bent using the related art.

FIGS. 29(*a*) to 29(*e*) are graphs which shows the highest arrival temperature and the temperature distribution (vertical axis) at a current time with respect to the positions (horizontal axis) on the steel pipe 1 in the case where portions except for the front end section 1*b* and the rear end section 1*d* of the steel pipe 1 are bent using the related art.

FIG. 29(*a*) shows a state where the first heated portion is formed at a position different from the front end section 1*b* and the rear end section 1*d* of the steel pipe 1 by supplying high-frequency power to the induction heating device 5 while feeding the steel pipe 1 in the longitudinal direction. In addition, a step of forming the first heated portion is referred to as a first heating step.

FIG. 29(*b*) shows a state where the induction heating, the cooling and the feeding of the steel pipe 1 are performed from the state shown in FIG. 29(*a*). At the time shown in FIG. 29(*b*), only the induction heating of the steel pipe 1 is stopped in a state where the cooling and feeding of the steel pipe 1 are performed. Accordingly, the non-quenching portion is formed between the first heated portion and the second heated portion. In addition, the step of forming the non-quenching portion between the first heated portion and the second heated portion is referred to as a heating stop step.

FIG. 29(*c*) shows a state where the cooling and the feeding of the steel pipe 1 are performed from the state shown in FIG. 29(*b*). At the time shown in FIG. 29(*c*), the induction heating of the steel pipe 1 is restarted and the second heated portion is formed at a position on the upstream side of the first heated portion. In addition, the step of forming the second heated portion is referred to as a second heating step. As shown in FIG. 29(*c*), a portion which is heated in both of the first heating step and the second heating step is generated.

FIG. 29(*d*) shows a state where the induction heating, the cooling, and the feeding of the steel pipe 1 are performed from the state shown in FIG. 29(*c*).

FIG. 29(*e*) shows a state where the induction heating, the cooling, and the feeding of the steel pipe 1 are performed from the state shown in FIG. 29(*d*).

As shown in FIG. 29(*e*), in the case where the related art is used, the portion in which the highest arrival temperature is the Ac1 point or lower does not exist after the first heating step, the heating stop step, and the second heating step are finished. Accordingly, the portion (hereinafter, referred to as a base metal hardness portion) having the same hardness as that of the base metal is not formed.

In addition, as described above, the base metal hardness portion is not formed in the case where the related art is used. However, even when the portion in which the highest arrival temperature is higher than the Ac1 point and is lower than the Ac3 point is cooled, since the portion is not quenched, the non-quenching portion is formed.

Unlike the above-described method, a method is considered, which lengthens the heating stop step in order to form the base metal hardness portion between the first heated portion and the second heated portion. However, in the case where the heating stop step is lengthened, since the width dimension of the non-quenching portion increases, an unnecessary portion may be generated, and economic efficiency of the bent member decreases.

In addition, the present inventors found that the base metal hardness portion which was 1.40 times or less of the heating width between the first heated portion and the second heated portion performed by the induction heating device 5 could not be formed in the case where the related art was used.

The present inventors found that the width dimension of the non-quenching portion formed between the first heated portion and the second heated portion could be decreased and the hardness of the non-quenching portion formed between the first heated portion and the second heated portion could be the same as the hardness of the base metal by applying the heating amount which was greater than the heating amount applied to the first heated portion to the second heated portion when the second heating step is started.

Figure 23:
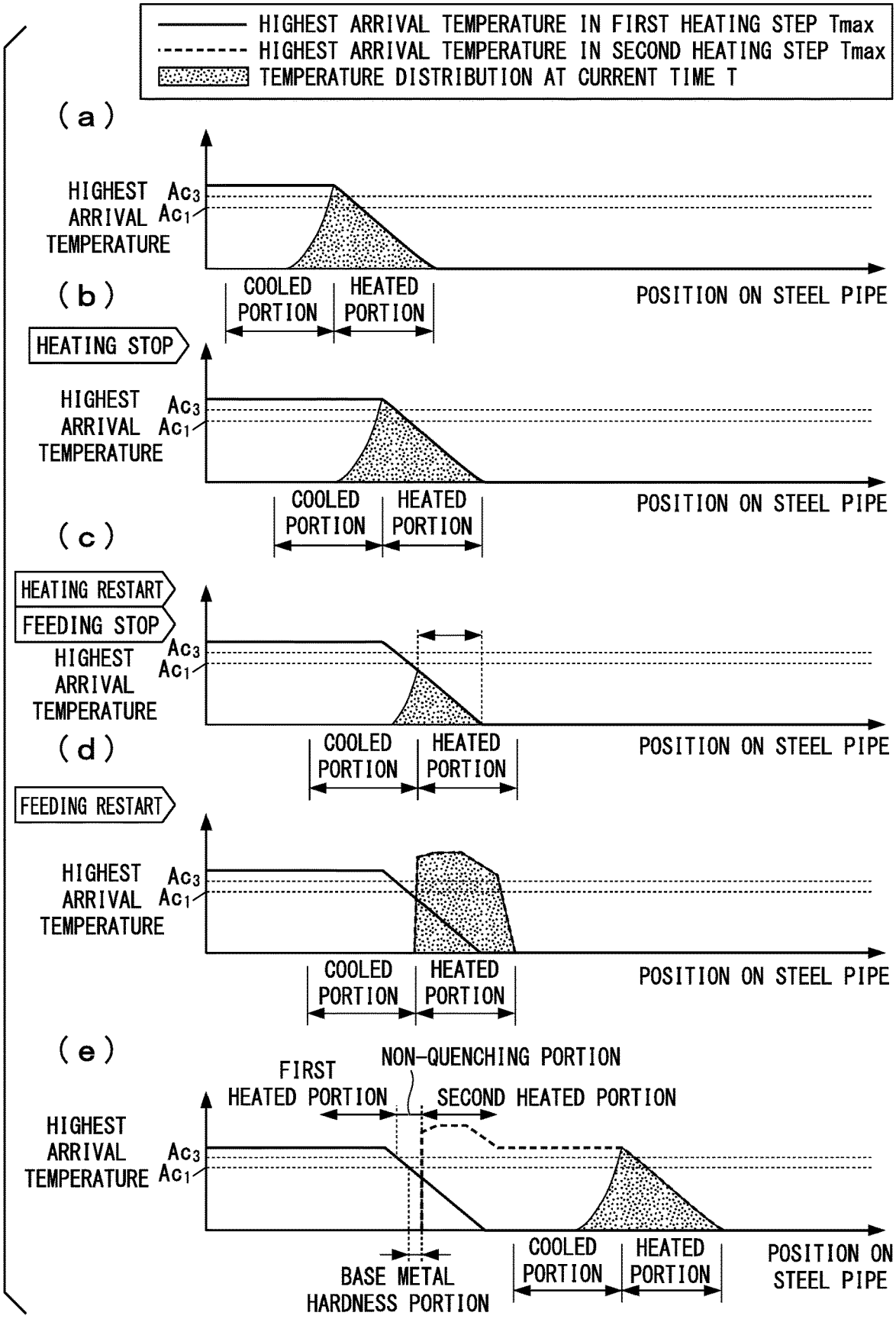
FIGS. 23(*a*) to 23(*e*) are graphs which show the highest arrival temperature and the temperature distribution at a current time with respect to the positions on the steel pipe in a case where portions except for the front end section and the rear end section of the steel pipe are bent using the present invention.

FIGS. 23(*a*) to 23(*e*) are graphs which show the highest arrival temperature and the temperature distribution (vertical axis) at a current time with respect to the positions (horizontal axis) on the steel pipe 1 in a case where portions except for the front end section 1*b* and the rear end section 1*d* of the steel pipe 1 are bent using the present embodiment.

FIG. 23(*a*) shows a state where the first heated portion is formed at a position different from the front end section 1*b* and the rear end section 1*d* of the steel pipe 1 by supplying high-frequency power to the induction heating device 5 while feeding the steel pipe 1 in the longitudinal direction (first heating step).

FIG. 23(*b*) shows a state where the induction heating, the cooling and the feeding of the steel pipe 1 are performed from the state shown in FIG. 23(*a*). At the time shown in FIG. 23(*b*), only the induction heating of the steel pipe 1 is stopped in a state where the cooling and feeding of the steel pipe 1 are performed. Accordingly, the non-quenching portion is formed between the first heated portion and the second heated portion (heating stop step).

FIG. 23(*c*) shows a state where the cooling and the feeding of the steel pipe 1 are performed from the state shown in FIG. 23(*b*). At the time shown in FIG. 23(*c*), the induction heating of the steel pipe 1 is restarted, the second heated portion is formed (second heating step), and the feeding of the steel pipe 1 is stopped.

FIG. 23(*d*) shows a state where the induction heating and the cooling of the steel pipe 1 are performed from the state shown in FIG. 23(*c*). At the time shown in FIG. 23(*d*), the feeding of the steel pipe 1 is restarted.

FIG. 23(*e*) shows a state where the induction heating, the cooling, and the feeding of the steel pipe 1 are performed from the state shown in FIG. 23(*d*).

According to the present embodiment, as described above, since the induction heating is performed in the state where the feeding of the steel pipe 1 is stopped when the second heating step is started, the heat amount applied to the second heated portion when the second heated portion is formed is greater than the heating amount applied to the first heated portion when the first heated portion is formed. Accordingly, as shown in FIG. 23(*e*), the portion in which the highest arrival temperature is the Ac1 point or lower is generated. Therefore, according to the manufacturing method for a bent member of the present embodiment, it is possible to form the base metal hardness portion between the first heated portion and the second heated portion.

In addition, when the second heating step is started, as the method which allows the heat amount applied to the second heated portion when the second heated portion is formed to be greater than the heating amount applied to the first heated portion when the first heated portion is formed, there is a method in which the induction heating is performed in a state where the feeding of the steel pipe 1 is not stopped and the feeding speed is decelerated when the second heating step is started. In addition, when the second heating step is started, as the method which allows the heat amount applied to the second heated portion when the second heated portion is formed to be greater than the heating amount applied to the first heated portion when the first heated portion is formed, there is a method in which the feeding speed of the steel pipe 1 is not changed and the high-frequency electric energy supplied to the induction heating device 5 is increased when the second heating step is started.

As described above, when the second heating step is started, since the heat amount applied to the second heated portion when the second heated portion is formed is greater than the heating amount applied to the first heated portion when the first heated portion is formed, it is possible to form the base metal hardness portion between the first heated portion and the second heated portion. Accordingly, it is possible to easily cut the bent member.

Moreover, when the second heating step is started, since the heat amount applied to the second heated portion when the second heated portion is formed is greater than the heating amount applied to the first heated portion when the first heated portion is formed, it is possible to decrease the width dimension of the non-quenching portion formed between the first heated portion and the second heated portion. Specifically, the width dimension of the non-quenching portion formed between the first heated portion and the second heated portion can be 0.15 times or more and 1.40 times or less of the heating width by the induction heating device 5. Accordingly, since the unnecessary portion is not generated when the bent member is cut, it is possible to improve economic efficiency in the manufacturing of the bent member.

[Hot-Bending Apparatus for Steel Material]

Next, a hot-bending apparatus for a steel material according to the present embodiment will be described.

Figure 7:
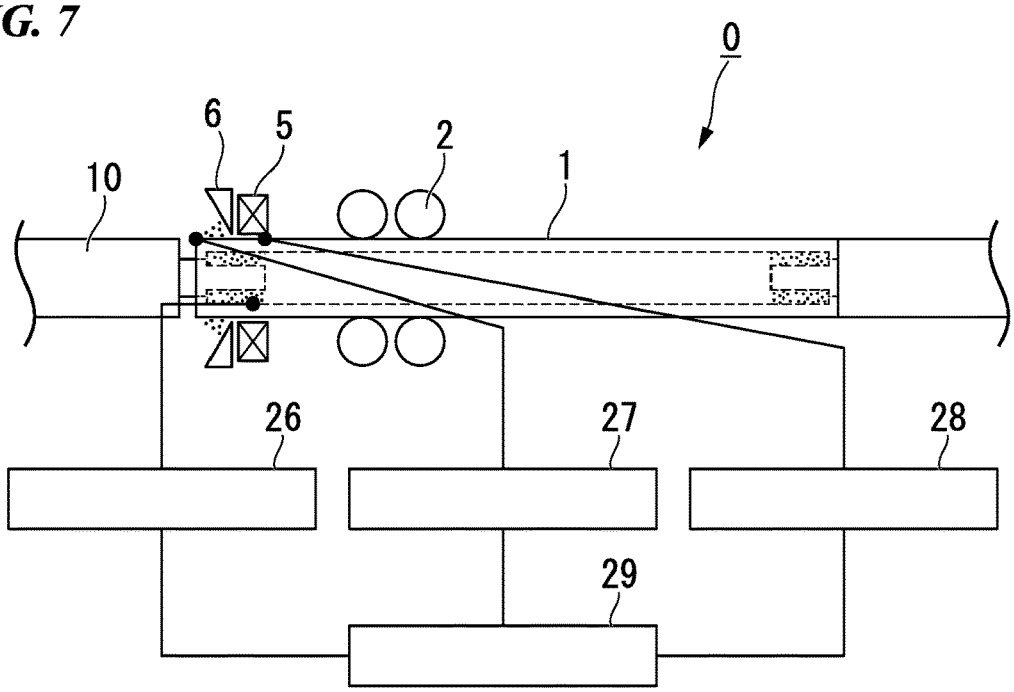
FIG. 7 is an explanatory view showing a configuration example of the hot-bending apparatus for a steel material according to the present invention.

FIG. 7 is an explanatory view showing a configuration example of the hot-bending apparatus for a steel material according to the present embodiment.

As shown in FIG. 7, the hot-bending apparatus 0 includes a support device (support mechanism) 2, the feeding device (feeding mechanism) 3, the induction heating device (induction heating mechanism) 5, the cooling device (cooling mechanism) 6, a drive device (drive mechanism) 9, the chuck 10, a first temperature measurement device (first temperature measurement mechanism) 26, a shape measurement device (shape measurement mechanism) 27, a second temperature measurement device (second temperature measurement mechanism) 28, and a controller 29.

The feeding device 3 feeds the steel pipe 1 in the longitudinal direction. In the feeding of the steel pipe 1 performed by the feeding device 3, the feeding speed may be constant or may be changed. In addition, the feeding of the steel pipe 1 performed by the feeding device 3 may be continuous or may be intermittent.

The support device 22 supports the steel pipe 1 which is fed by the feeding device 3.

The induction heating device 5 partially induction-heats the steel pipe 1. In the induction heating of the steel pipe 1 performed by the induction heating device 5, the high-frequency electric energy supplied to the induction heating device 5 may be constant or may be changed. In addition, the induction heating of the steel pipe 1 performed by the induction heating device 5 may be continuous or may be intermittent.

The cooling device 6 injects the cooling medium to partially cool the steel pipe 1. As an example of the cooling medium, water is exemplified.

The drive device 9 three-dimensionally moves the chuck 10 holding the front end section 1*b* of the steel pipe 1 to apply a bending moment to the heated portion 1*a* of the steel pipe 1.

The chuck 10 holds the front end section 1*b* and the rear end section 1*d* of the steel pipe 1.

The feeding device 3, the support device 22, the induction heating device 5, the cooling device 6, and the chuck 10 are disposed along the longitudinal direction of the steel pipe 1.

The controller 29 controls the feeding device 3, the induction heating device 5, the cooling device 6, the drive device 9, and the chuck 10.

The controller 29 controls the induction heating device 5 such that the heating amount when the heated portion 1*a* is formed on the front end section 1*b* of the steel pipe 1 is greater than the heating amount when the heated portion 1*a* is formed on the upstream side adjacent portion. Moreover, the controller 29 performs a control such that the chuck 10 is cooled using the cooling medium by the cooling device 6 when the heated portion 1*a* is formed on the front end section 1*b* of the steel pipe 1 by the induction heating device 5.

The controller 29 may control the induction heating device 5 such that the heating amount applied to the rear end section 1*d* of the steel pipe 1 when the heated portion 1*a* is formed on the rear end section 1*d* is greater than the heating amount applied to the downstream side adjacent portion when the heated portion 1*a* is formed on the downstream side adjacent portion.

The controller 29 may control the induction heating device 5 such that the first heated portion is formed between the front end section 1*b* and the rear end section 1*d* of the steel pipe 1, the second heated portion is formed at the position on the upstream side of the first heated portion, and the non-quenching portion is formed at the position between the first heated portion and the second heated portion.

The first temperature measurement device 26 measures the temperature of the front end section 1*b* of the steel pipe 1. As an example of the first temperature measurement device 26, a thermocouple which is embedded into the click 10*b* of the chuck 10, a thermocouple which measures a thermo-electromotive force between the chuck 10 and the steel pipe 1, a contact type thermometer, a non-contact type thermometer, or the like can be used.

The shape measurement device 27 measures an outline distortion amount of the front end section 1*b* of the steel pipe 1. As the shape measurement device 27, a contact type displacement gauge, a non-contact type displacement gauge, a measurement device for measuring a movement amount of the click 10*b* of the chuck 10, or the like can be used.

The second temperature measurement device 28 measures the temperature of the heated portion 1*a* formed on the steel pipe 1. As the second temperature measurement device 28, a non-contact type thermometer incorporated to the induction heating device 5 or the like can be used.

The controller 29 may control at least one of the feeding device 3 and the induction heating device 5 such that at least one of the temperature of the front end section 1*b* of the steel pipe 1 measured by the first temperature measurement device 26, the outline distortion amount of the front end section 1*b* of the steel pipe 1 measured by the shape measurement device 27, and the temperature of the heated portion 1*a* of the steel pipe 1 measured by the second temperature measurement device 28 is within a predetermined range.

The controller 29 may change at least one of the feeding speed of the steel pipe 1 by the feeding device 3 and the high-frequency power supplied to the induction heating device 5 after the feeding of the steel pipe 1 performed by the feeding device 3 and the induction heating of the steel pipe 1 performed by the induction heating device 5 are started such that at least one of the temperature of the front end section 1*b* of the steel pipe 1 measured by the first temperature measurement device 26, the outline distortion amount of the front end section 1*b* of the steel pipe 1 measured by the shape measurement device 27, and the temperature of the heated portion 1*a* of the steel pipe 1 measured by the second temperature measurement device 28 is within a predetermined range.

In addition, the controller 29 may start the feeding of the steel pipe 1 performed by the feeding device 3 after a predetermined time elapses from the start of the induction heating of the steel pipe 1 performed by the induction heating device 5, such that at least one of the temperature of the front end section 1*b* of the steel pipe 1 measured by the first temperature measurement device 26, the outline distortion amount of the front end section 1*b* of the steel pipe 1 measured by the shape measurement device 27, and the temperature of the heated portion 1*a* of the steel pipe 1 measured by the second temperature measurement device 28 is within a predetermined range.

EXAMPLE

The present invention will be specifically described with reference to Example and Comparative Example.

Example 1

By bending a steel pipe including an opening end having an outer diameter of 31.8 mm and a thickness of 2.0 mm using 3DQ, an S shaped bending portion was formed in a center portion of the steel pipe in the longitudinal direction. The hardness at the center portion of the bent steel pipe in the longitudinal direction was 520 Hv. As a representative chemical composition of the steel pipe, C content was 0.22 mass % and Mn content was 1.25 mass %. In addition, Example 1 was an example corresponding to the first embodiment.

Figure 8:
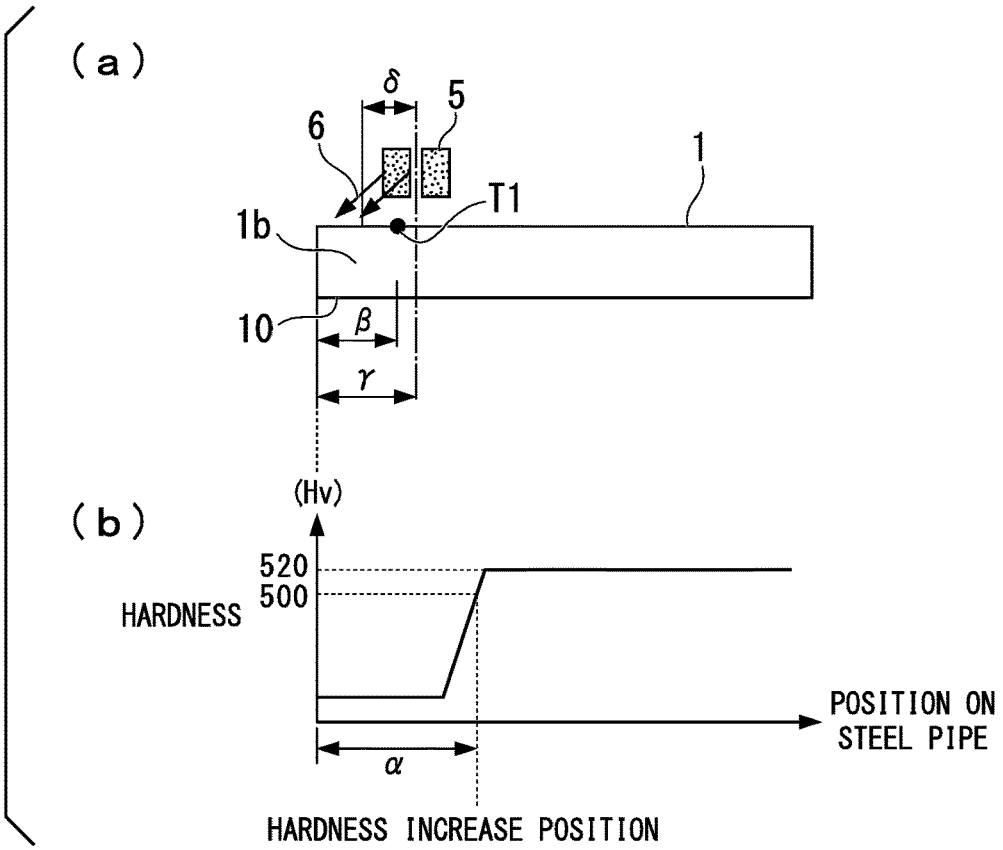
FIG. 8(*a*) is a schematic view showing the positional relationship among the steel pipe, the induction heating device, and the cooling device in Example 1.

FIG. 8(*a*) is a schematic view showing the positional relationship among the steel pipe, the induction heating device, and the cooling device in Example 1. FIG. 8(*b*) is a graph which shows the hardness (vertical axis) of the steel pipe in Example 1 with respect to the position (horizontal axis) on the steel pipe.

As the induction heating device, a two-turn coil was used. The feeding speed of the steel pipe was set to a constant speed, and was 80 mm/second. Constant high-frequency electric energy (142 kW) was supplied to the induction heating device such that the highest arrival temperature of the steel pipe be higher than 1000° C.

In FIGS. 8(*a*) and 8(*b*), β shown in FIG. 8(*a*) is a contacting distance of the click 10*b* of the chuck 10 with the inner surface of the steel pipe, and was set to 20 mm. γ shown in FIG. 8(*a*) is a distance from the front end section of the steel pipe and the center portion (hereinafter, referred to as a heating start position) of the heated portion in the longitudinal direction when the induction heating was started. δ shown in FIG. 8(*a*) is a distance from the heating start position to the upstream end of the cooled portion, and was set to 27 mm. α shown in FIG. 8(*b*) is a distance from the front end section to a position (hereinafter, referred to as a hardness increase position) at which the hardness is 500 Hv.

FIG. 9(*a*) is a side view of the steel pipe for explaining the positions A and B. FIG. 9(*b*) is a graph which shows the highest arrival temperatures (vertical axis) at the positions A and B with respect to the position (horizontal axis) on the steel pipe. FIG. 9(*c*) is a graph which shows the hardness (vertical axis) of the steel pipe at the positions A and B with respect to the position (horizontal axis) on the steel pipe.

Example 1-1

Figure 10:
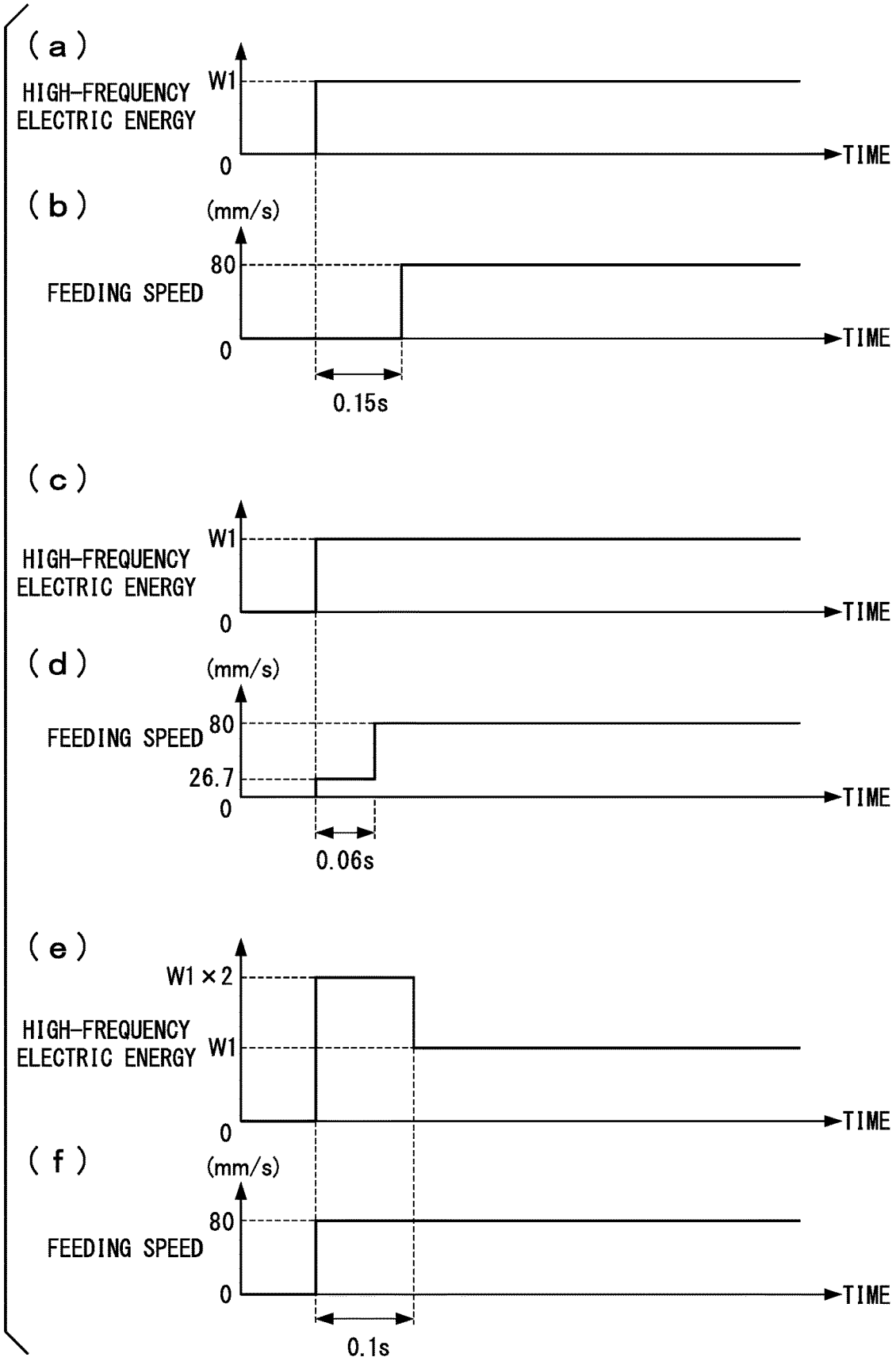
FIG. 10(*a*) is a graph which shows high-frequency electric energy supplied to an induction heating device of Example 1-1 with respect to time.

Example 1-1 is an example corresponding to Aspect Example 1-1, and in Example 1-1, the feeding of the steel pipe was started after 0.15 seconds from the start of supplying of the high-frequency power to the induction heating device. In Example 1-1, a relationship between the high-frequency electric energy (vertical axis) supplied to the induction heating device and time (horizontal axis) is shown in FIG. 10(*a*), and in Example 1-1, a relationship between the feeding speed (vertical axis) and time (horizontal axis) is shown in FIG. 10(*b*).

Example 1-2

Example 1-2 is an example corresponding to Aspect Example 1-2, and in Example 1-2, the feeding of the steel pipe was started at the feeding speed of 26.7 mm/second simultaneously with the start of supplying of the high-frequency power to the induction heating device, and the feeding speed of the steel pipe was changed to 80 mm/second after 0.06 seconds. In Example 1-2, a relationship between the high-frequency electric energy (vertical axis) supplied to the induction heating device and time (horizontal axis) is shown in FIG. 10(*c*), and in Example 1-2, a relationship between the feeding speed (vertical axis) and time (horizontal axis) is shown in FIG. 10(*d*).

Example 1-3

Example 1-3 is an example corresponding to Aspect Example 1-3, and in Example 1-3, the feeding of the steel pipe was started simultaneously with the start of the supplying of the high-frequency power to the induction heating device. When the supplying of the high-frequency power to the induction heating device was started, the supply amount of the high-frequency power to the induction heating device was set to 2 times of the supply amount of the high-frequency power to the induction heating device in Example 1-1 and Example 1-2. Next, the high-frequency electric energy supplied to the induction heating device after 0.1 seconds from the start of the supplying of the high-frequency power to the induction heating device and the start of the feeding of the steel pipe was changed to 0.5 times. In Example 1-3, a relationship between the high-frequency electric energy (vertical axis) supplied to the induction heating device and time (horizontal axis) is shown in FIG. 10(*e*), and in Example 1-3, a relationship between the feeding speed (vertical axis) and time (horizontal axis) is shown in FIG. 10(*f*).

Comparative Example 1-1

Figure 11:
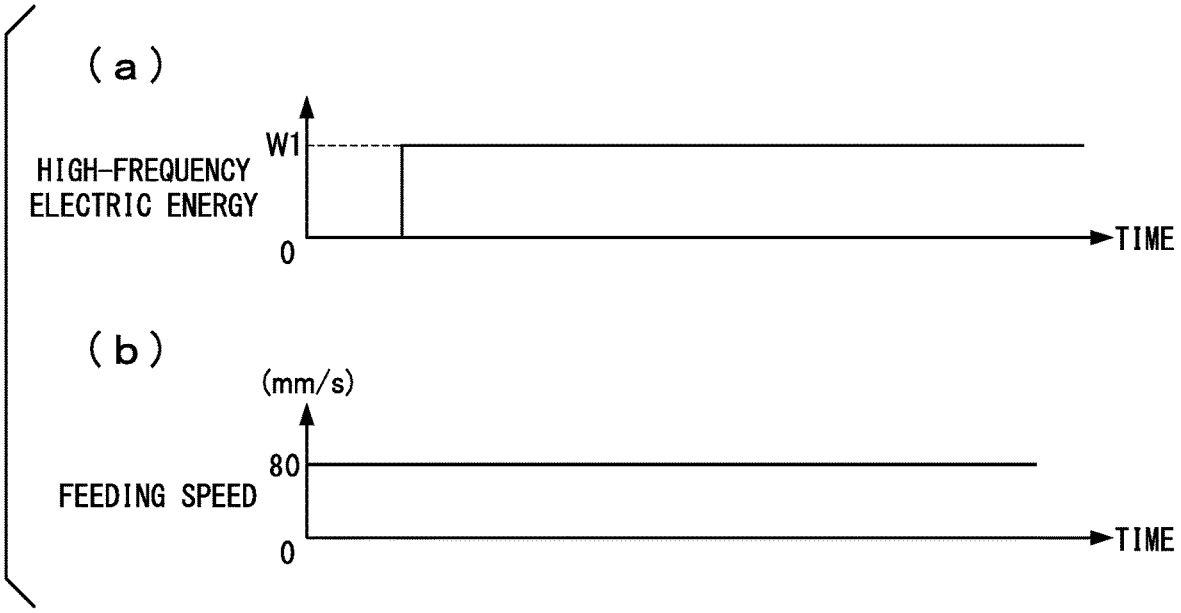
FIG. 11(*a*) is a graph which shows high-frequency electric energy supplied to an induction heating device of Comparative Example 1-1 with respect to time.
Figure 12:
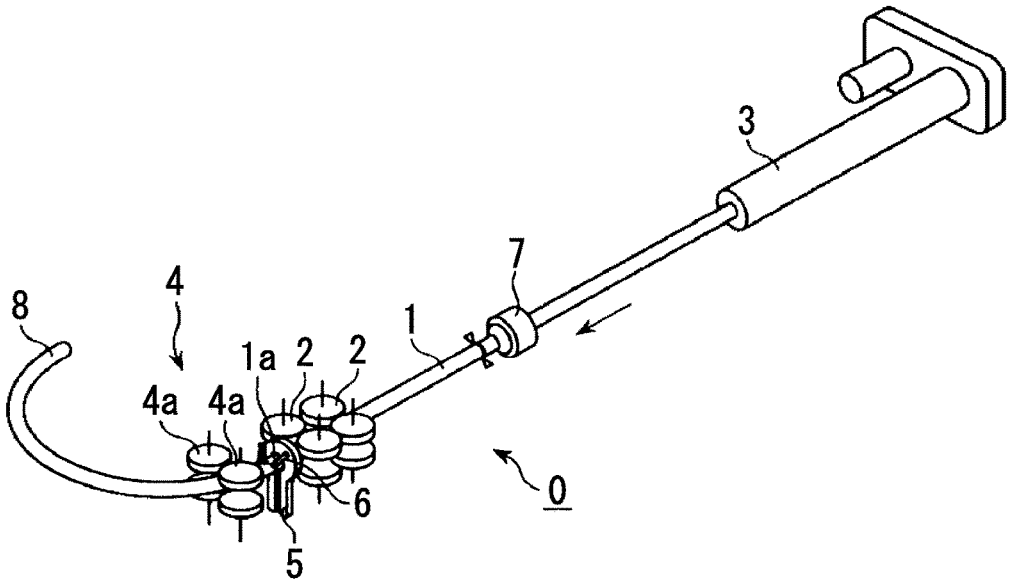
FIG. 12 is a schematic view showing a hot-bending apparatus for a steel material disclosed in Patent Document 1.
Figure 13A:
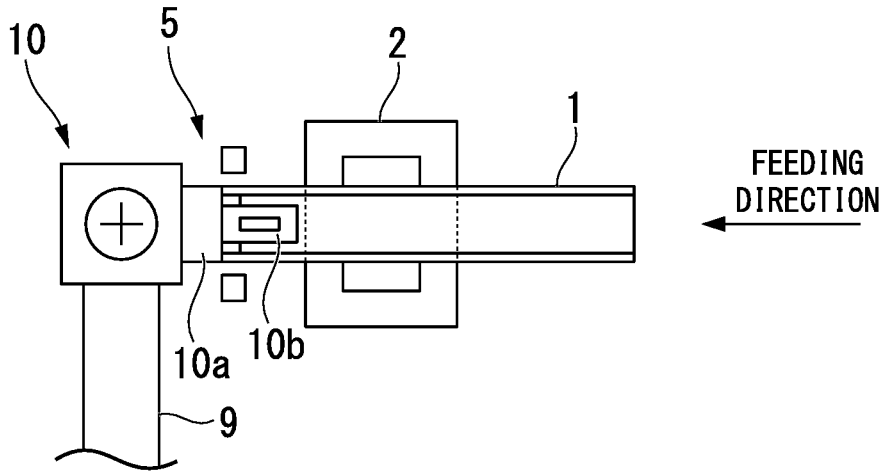
FIG. 13A is a schematic view showing a case where the inner portion of the steel pipe is held by a short chuck.
Figure 13B:
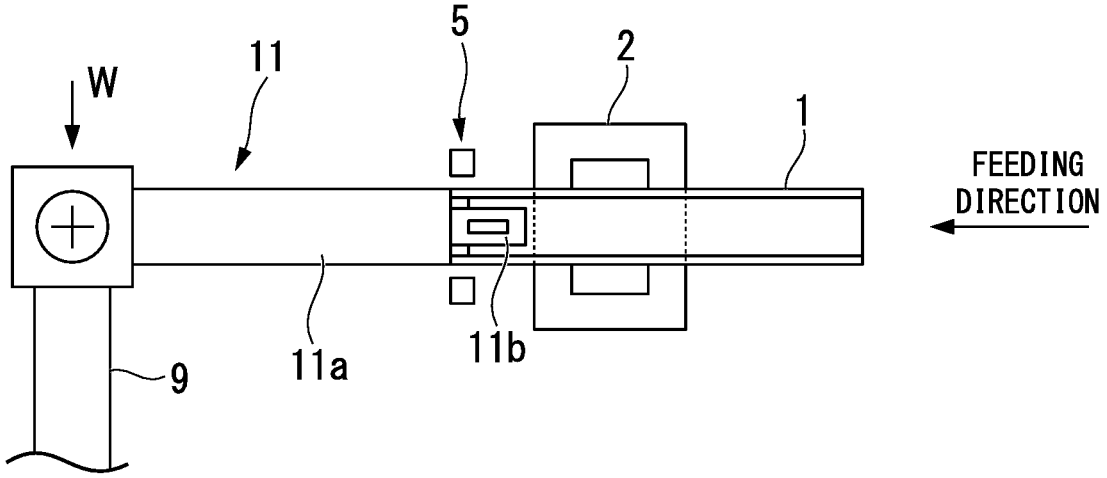
FIG. 13B is a schematic view showing a case where the inner portion of the steel pipe is held by a long chuck.
Figure 14A:
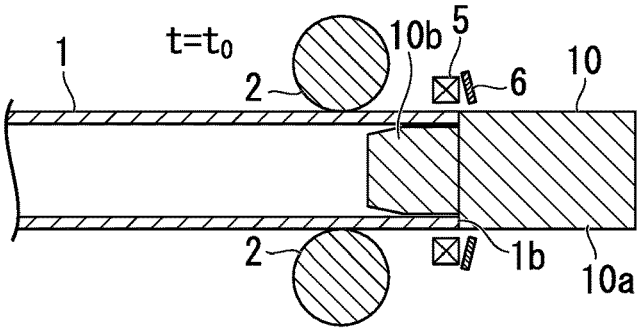
FIG. 14A is a schematic view showing a steel material and a hot-bending apparatus for a steel material in a case where the vicinity of a front end section of the steel pipe is bent according to the related art.
Figure 14B:
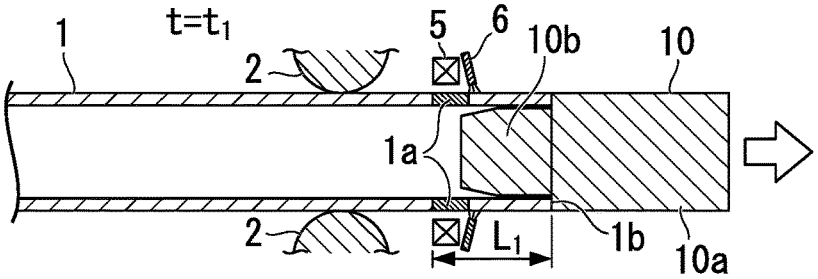
FIG. 14B is a schematic view showing the steel material and the hot-bending apparatus for a steel material in a case where the vicinity of the front end section of the steel pipe is bent according to the related art.
Figure 14C:
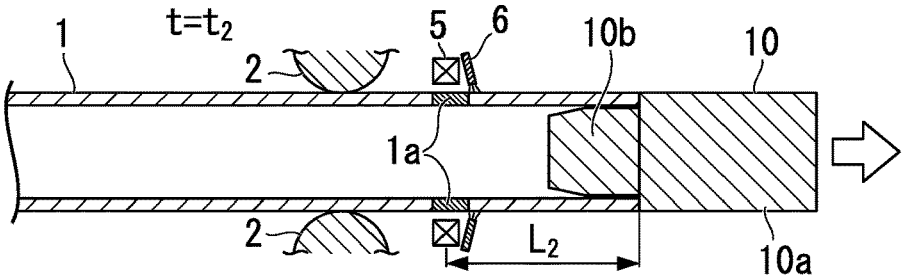
FIG. 14C is a schematic view showing the steel material and the hot-bending apparatus for a steel material in a case where the vicinity of the front end section of the steel pipe is bent according to the related art.
Figure 14D:
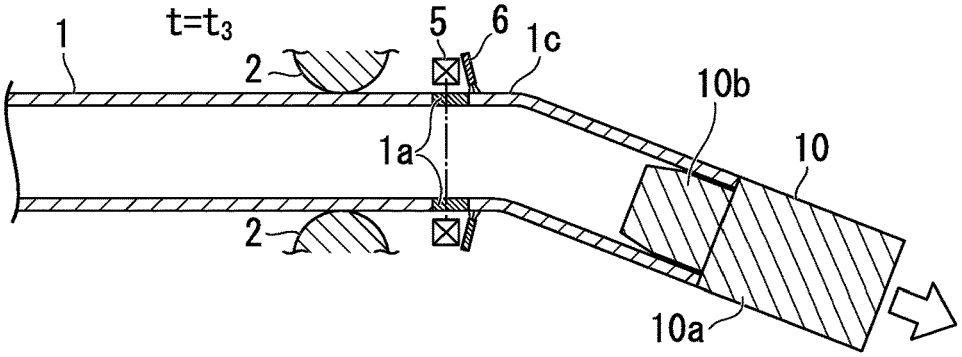
FIG. 14D is a schematic view showing the steel material and the hot-bending apparatus for a steel material in a case where the vicinity of the front end section of the steel pipe is bent according to the related art.

In Comparative Example 1-1, since the supplying of the high-frequency power to the induction heating device was started after a predetermined time elapsed from the start of the feeding of the steel pipe, the high-frequency electric energy supplied to the induction heating device and the feeding speed of the steel pipe respectively were constant values from the start. In Comparative Example 1-1, a relationship between the high-frequency electric energy (vertical axis) supplied to the induction heating device and time (horizontal axis) is shown in FIG. 11(*a*), and in Comparative Example 1-1, a relationship between the feeding speed (vertical axis) and time (horizontal axis) is shown in FIG. 11(*b*).

In Examples 1-1 to 1-3 and Comparative Example 1-1, the highest temperatures of the clicks of the chucks, the highest arrival temperatures of the steel pipes, the distances from the front end sections of the steel pipes to the heating start positions, the distances from the front end sections of the steel pipes to the hardness increase positions, the distances from the front end sections of the steel pipes to the bending starting positions, and the distances between the hardness increase positions at the position A and the hardness increase positions at the position B are shown in Table 1.

TABLE 1

| | Highest arrival temperature of click of chuck holding front end section of steel pipe | Highest arrival temperature of steel pipe | Distance from front end section of steel pipe to heating start position | Distance from front end section of steel pipe to hardness increase position | Distance from front end section of steel pipe to bending start position | Distance between hardness increase position at position A and hardness increase position at position B |
|---|---|---|---|---|---|---|
| Example 1-1 | 465° C. | 1071° C. | 30 mm | 30 mm | 45 mm | 4 mm |
| Example 1-2 | 493° C. | 1086° C. | 28 mm | 30 mm | 44 mm | 3 mm |
| Example 1-3 | 483° C. | 1095° C. | 27 mm | 30 mm | 45 mm | 4 mm |
| Comparative Example 1-1 | 476° C. | 1000° C. | 21 mm | 35 mm | 54 mm | 11 mm |

In Comparative Example 1-1, even when the heating was started from the position of 21 mm from the front end section of the steel pipe, the distance from the front end section to the hardness increase position was 35 mm, and the distance from the front end section to the bending starting position was 54 mm.

On the other hand, in each of Examples 1-1 to 1-3, the highest arrival temperatures of the click of the chuck and the steel pipe were decreased so as to be a predetermined temperature or lower, and the distance from the front end section of the steel pipe to the hardness increase position and the distance from the front end section of the steel pipe to the bending starting position could be shorter than those of Comparative Example 1-1. On the other hand, in each of Examples 1-1 to 1-3, the distance from the front end section of the steel pipe to the heating start position could be longer than those of Comparative Example 1-1.

In addition, in each of Examples 1-1 to 1-3, the distance between the hardness increase position at the position A and the hardness increase position at the position B could be shorter than that of Comparative Example 1-1.

Example 2

By bending a steel pipe including an opening end having an outer diameter of 31.8 mm and a thickness of 2.0 mm using 3DQ, an S shaped bending portion was formed in a center portion of the steel pipe in the longitudinal direction. The hardness at the center portion of the bent steel pipe in the longitudinal direction was 520 Hv. As a representative chemical composition of the steel pipe, C content was 0.22 mass % and Mn content was 1.25 mass %. In addition, Example 2 was an example corresponding to the second embodiment As the induction heating device, a two-turn coil was used. The feeding speed of the steel pipe was set to a constant speed, and was 80 mm/second. Constant high-frequency electric energy (142 kW) was supplied to the induction heating device such that the highest arrival temperature of the steel pipe becomes 1000° C.

Under the above-described conditions, a condition was examined, in which when the vicinity of the rear end section of the steel pipe was bent, the click of the chuck holding the rear end section of the steel pipe was not heated higher than 500° C., the steel pipe was not heated higher than 1100° C., and the width dimension of the non-quenching portion formed on the rear end section of the steel pipe was decreased as much as possible.

Specifically, in each of Example and Comparative Example, the highest arrival temperature of the click of the chuck holding the rear end section of the steel pipe, the highest arrival temperature of the steel pipe, the distance (distance G) from the heating end position of the steel pipe to the rear end section, the distance (distance H) from the hardness decrease position of the steel pipe to the rear end section, the distance from the bending end position of the steel pipe to the rear end section, and the distance between the hardness decrease position at the position A and the hardness decrease position at the position B were obtained.

Example 2-1

In Example 2-1, only the feeding was stopped from the state where the induction heating, the cooling, and the feeding of the steel pipe were performed, and the supplying of the high-frequency power to the induction heating device was stopped after 0.15 seconds from the stopping of the feeding.

Figure 20:
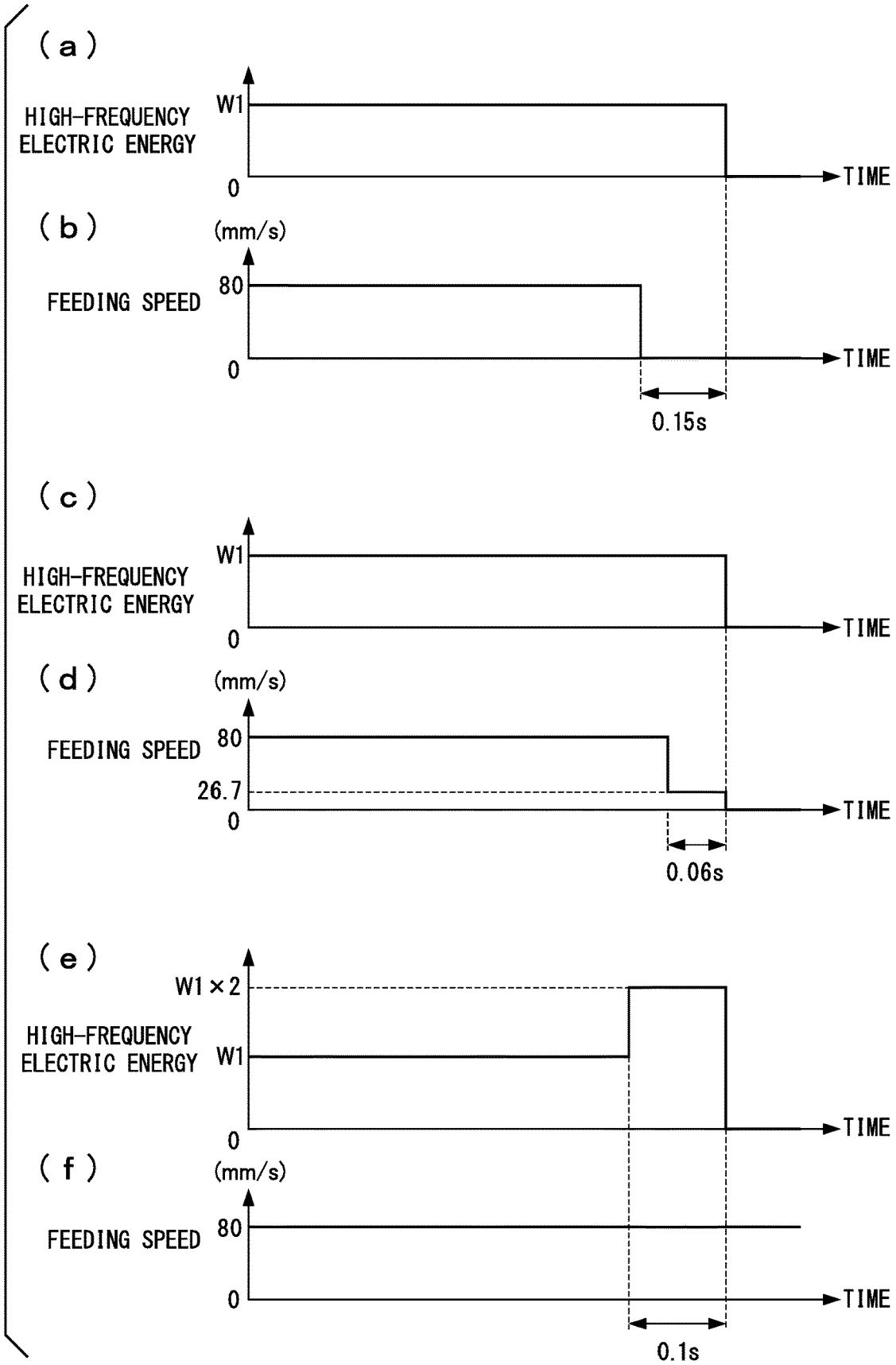
FIG. 20(*a*) is a graph which shows high-frequency electric energy supplied to an induction heating device of Example 2-1 with respect to time.

FIG. 20(*a*) is a graph which shows high-frequency electric energy (vertical axis) supplied to the induction heating device of Example 2-1 with respect to time (horizontal axis). FIG. 20(*b*) is a graph which shows the feeding speed (vertical axis) of the steel pipe in Example 2-1 with respect to time (horizontal axis).

Example 2-2

In Example 2-2, the feeding speed was decelerated to ⅓ from the state where the induction heating, the cooling, and the feeding of the steel pipe were performed, and the supplying of the high-frequency power to the induction heating device was stopped after 0.06 seconds from the deceleration of the feeding speed.

FIG. 20(*c*) is a graph which shows high-frequency electric energy (vertical axis) supplied to the induction heating device of Example 2-2 with respect to time (horizontal axis). FIG. 20(*d*) is a graph which shows the feeding speed (vertical axis) of the steel pipe in Example 2-2 with respect to time (horizontal axis).

Example 2-3

In Example 2-3, the high-frequency power supplied to the induction heating device was increased to 2 times from the state where the induction heating, the cooling, and the feeding of the steel pipe were performed, and the supplying of the high-frequency power to the induction heating device was stopped after 0.1 seconds from the increase in the supplying of the high-frequency power to the induction heating device. In addition, in Example 2-3, the feeding of the steel pipe was performed at a constant feeding speed.

FIG. 20(*e*) is a graph which shows the high-frequency electric energy (vertical axis) supplied to the induction heating device of Example 2-3 with respect to time (horizontal axis). FIG. 20(*f*) is a graph which shows the feeding speed (vertical axis) of the steel pipe in Example 2-3 with respect to time (horizontal axis).

Comparative Example 2-1

In Comparative Example 2-1, the supplying of the high-frequency power to the induction heating device was stopped from the state where the induction heating, the cooling, and the feeding of the steel pipe were performed. Moreover, in Comparative Example 2-1, the feeding of the steel pipe was performed at a constant feeding speed.

Figure 21:
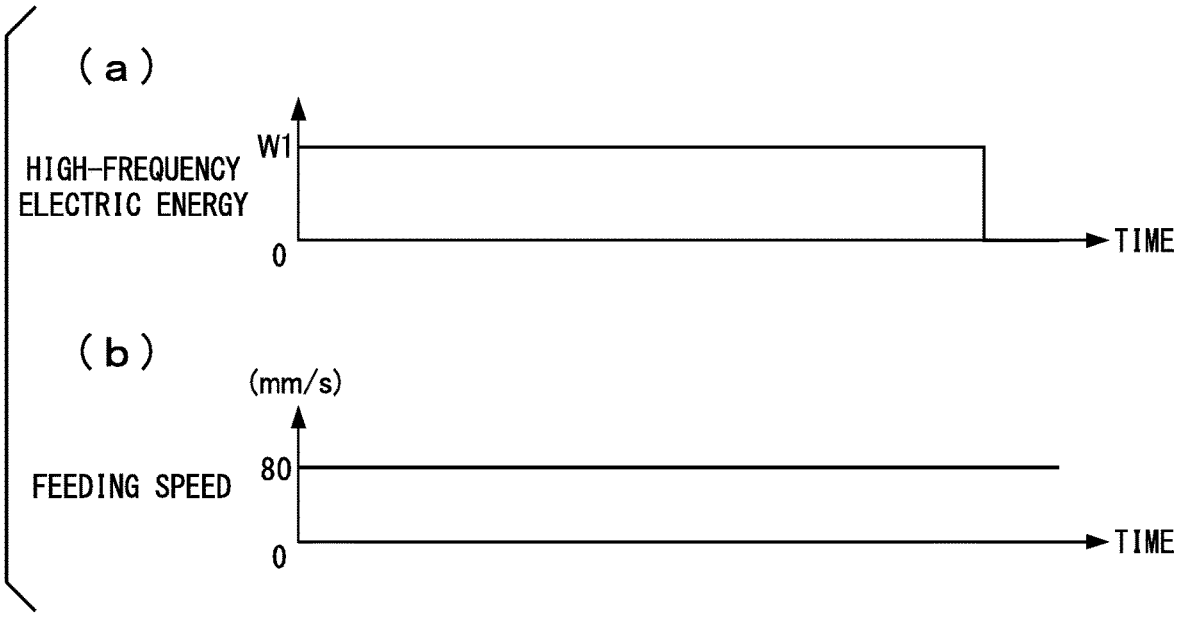
FIG. 21(*a*) is a graph which shows high-frequency electric energy supplied to an induction heating device of Comparative Example 2-1 with respect to time.

FIG. 21(*a*) is a graph which shows the high-frequency electric energy (vertical axis) supplied to the induction heating device of Comparative Example 2-1 with respect to time (horizontal axis). FIG. 21(*b*) is a graph which shows the feeding speed (vertical axis) of the steel pipe in Comparative Example 2-1 with respect to time (horizontal axis).

The results of Example 2-1 to 2-3 and Comparative Example 2-1 are shown in Table 2.

TABLE 2

| | Highest arrival temperature of click of chuck holding rear end section of steel pipe | Highest arrival temperature of steel pipe | Distance (distance G) from heating end position of steel pipe to rear end section | Distance (distance H) from hardness decrease position of steel pipe to rear end section | Distance from bending end position of steel pipe to rear end section | Distance between hardness decrease position at position A and hardness decrease position at position B |
|---|---|---|---|---|---|---|
| Example 2-1 | 476° C. | 1082° C. | 30 mm | 30 mm | 28 mm | 3 mm |
| Example 2-2 | 461° C. | 1097° C. | 29 mm | 30 mm | 28 mm | 3 mm |
| Example 2-3 | 478° C. | 1079° C. | 27 mm | 30 mm | 28 mm | 3 mm |
| Comparative Example 2-1 | 487° C. | 1000° C. | 21 mm | 34 mm | 31 mm | 9 mm |

As shown in Table 2, in each of Examples 2-1 to 2-3, the highest arrival temperature of the click of the chuck was 500° C. or lower, and the highest arrival temperature of the steel pipe was 1100° C. or lower. In addition, compared to Comparative Example 2-1, in each of Examples 2-1 to 2-3, the distance (distance H) from the hardness decrease position of the steel pipe to the rear end section and the distance from the bending end portion of the steel pipe to the rear end section was shorter. Accordingly, productivity and economic efficiency in the manufacturing of the bent member were improved. In addition, compared to Comparative Example 2-1, in each of Examples 2-1 to 2-3, the distance (distance G) from the heating end position of the steel pipe to the rear end section could be longer.

Moreover, compared to Comparative Example 2-1, in each of Examples 2-1 to 2-3, the distance between the hardness decrease position at the position A and the hardness decrease position at the position B was shorter. Accordingly, it was found that the steel pipe was uniformly quenched in the circumferential direction when the steel pipe was bent.

Example 3

A steel pipe including an opening end having an outer diameter of 31.8 mm and a thickness of 2.6 mm was bent using 3DQ. As the induction heating device, a two-turn coil was used. In addition, Example 3 is an example corresponding to the third embodiment.

Under the above-described conditions, in each of Example and Comparative Example, the first heated portion was formed at the position except for the front end section and the rear end section of the steel pipe, the second heated portion was formed at the position on the upstream side of the first heated portion, the non-quenching portion was formed between the first heated portion and the second heated portion, and the width dimension of the non-quenching portion and the formation situation of the base metal hardness were examined.

Example 3-1

Figure 26:
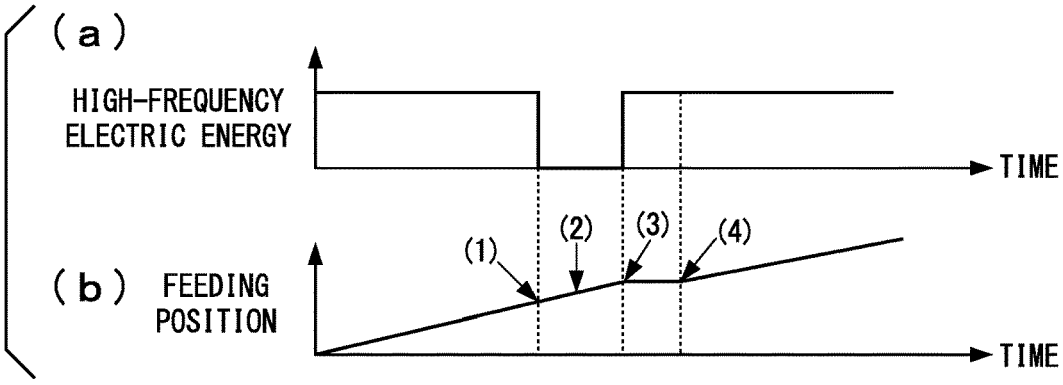
FIG. 26(*a*) is a graph which shows high-frequency electric energy supplied to an induction heating device of Example 3-1 with respect to time.

In Example 3-1, only the induction heating was stopped from the state where the induction heating, the cooling, and the feeding were performed on the steel pipe ((1) of FIG. 26(*b*)). In addition, in each of Examples 3-1 to 3-3, the high-frequency electric energy supplied to the induction heating device was set to 154 kW. Moreover, in Example 3-1, the feeding speed when the steel pipe was fed was set to 80 mm/second.

The induction heating to the steel pipe was restarted at the time when the steel pipe was fed by 15 mm downstream after the induction heating to the steel pipe was stopped, and the feeding of the steel pipe was stopped ((3) of FIG. 26(*b*)). The feeding of the steel pipe was restarted after 0.15 seconds from when the feeding of the steel pipe was stopped ((4) of FIG. 26(*b*)).

Example 3-2

Figure 27:
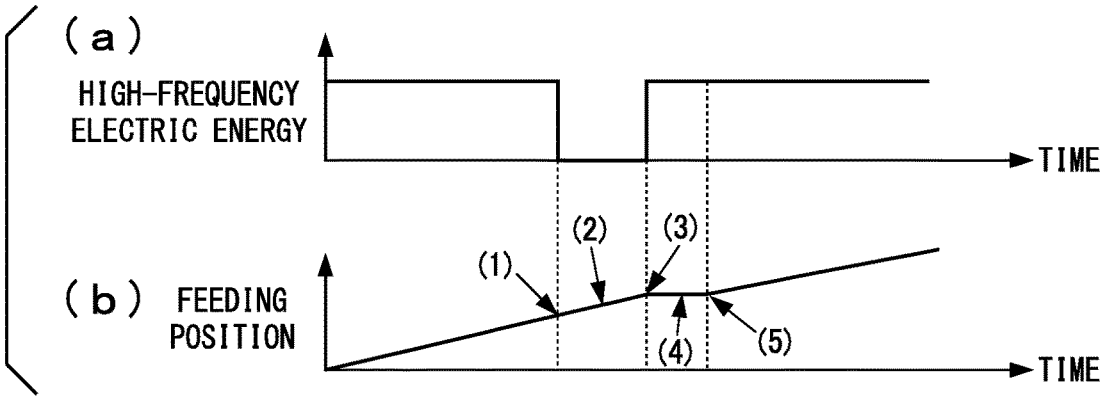
FIG. 27(*a*) is a graph which shows high-frequency electric energy supplied to an induction heating device of Example 3-2 with respect to time.

In Example 3-2, only the induction heating was stopped from the state where the induction heating, the cooling, and the feeding were performed on the steel pipe ((1) of FIG. 27(*b*)). At this time, the feeding speed of the steel pipe was set to 80 mm/second.

The induction heating to the steel pipe was restarted at the time when the steel pipe was fed by 13 mm downstream after the induction heating to the steel pipe was stopped, and the feeding speed of the steel pipe was decelerated from 80 mm/second to 10 mm/second ((3) of FIG. 27(*b*)). After 0.15 seconds from the deceleration in the feeding speed of the steel pipe, the feeding speed of the steel pipe was accelerated from 10 mm/second to 80 mm/second ((5) of FIG. 27(*b*)).

Example 3-3

Figure 28:
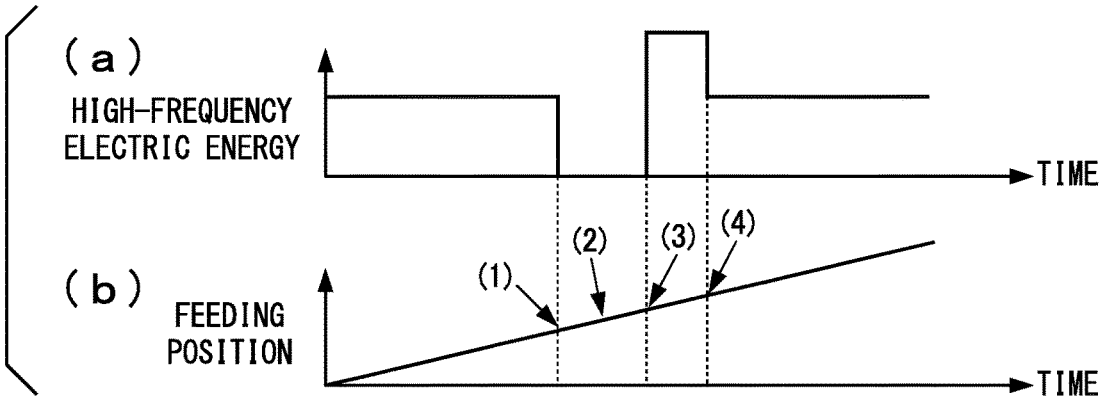
FIG. 28(*a*) is a graph which shows high-frequency electric energy supplied to an induction heating device of Example 3-3 with respect to time.

In Example 3-3, only the induction heating was stopped from the state where the induction heating (the high-frequency electric energy supplied to the induction heating device was set to 154 kW), the cooling, and the feeding of the steel pipe were performed ((1) of FIG. 28(*b*)). In addition, in Example 3-3, the feeding speed of the steel pipe was constantly set to 80 mm/second.

The induction heating in which the high-frequency electric energy supplied to the induction heating device was 308 kW was started at the time when the steel pipe was fed by 13 mm downstream after the induction heating to the steel pipe was stopped ((3) of FIG. 28(*b*)). After 0.15 seconds from when the induction heating in which the high-frequency electric energy supplied to the induction heating device was 308 kW was started, the high-frequency electric energy supplied to the induction heating device was decreased to 154 kW ((4) of FIG. 28(*b*)).

Comparative Examples 3-1 to 3-4

In each of Comparative Examples 3-1 to 3-4, only the induction heating was stopped from the state where the induction heating (the high-frequency electric energy supplied to the induction heating device was set to 200 kW), the cooling, and the feeding of the steel pipe were performed. The induction heating to the steel pipe was restarted at the time when the steel pipe was fed by a predetermined distance in the downstream direction after the induction heating to the steel pipe was stopped. The distance in which the steel pipe is fed in the downstream direction from the stop of the induction heating until the restart of the induction heating is referred to as a heating stop zone.

Figure 24:
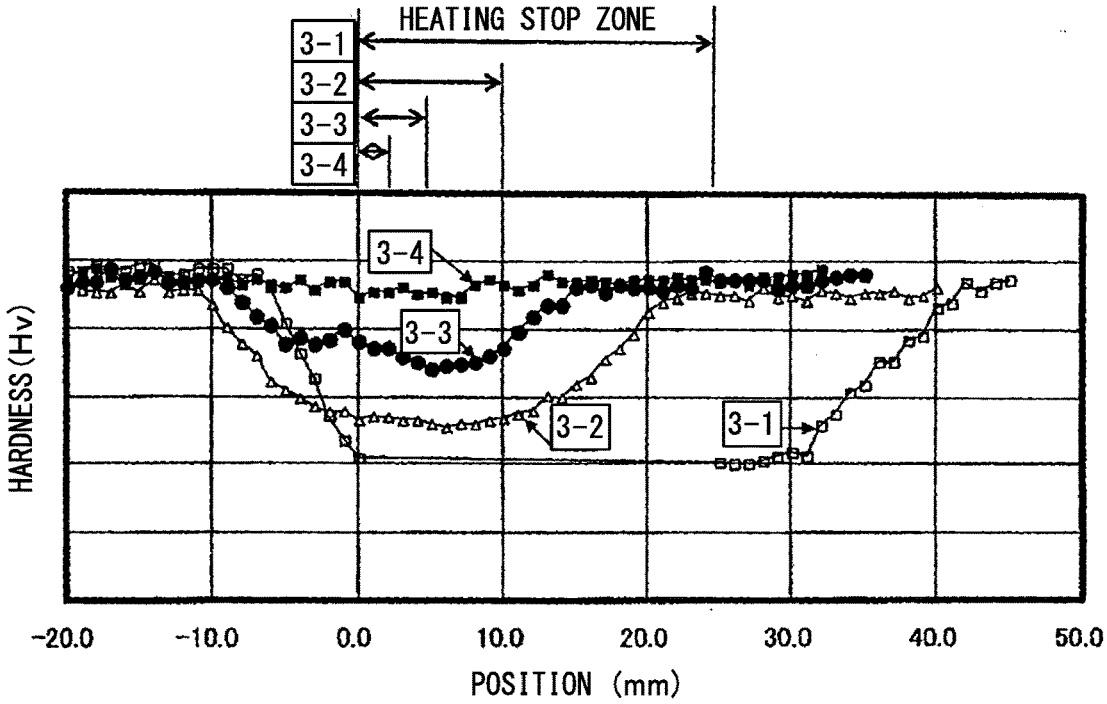
FIG. 24 is a graph which shows a relationship between the hardness of the steel pipe and the position on the steel pipe in Comparative Examples 3-1 to 3-4.
Figure 25:
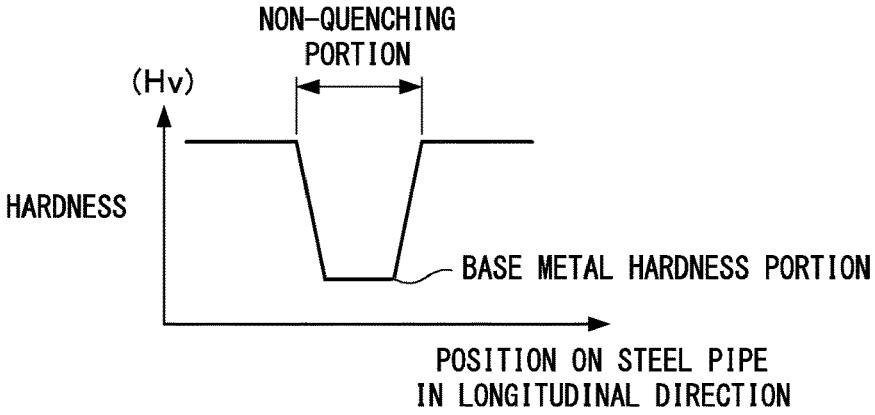
FIG. 25 is a conceptual view for explaining a non-quenching portion and a base metal hardness portion.

In Comparative Examples 3-1 to 3-4, the distances of the heating stop zones are different from each other. In the distance of the heating stop zone in each of the Comparative Examples, Comparative Example 3-1 was 25 mm, Comparative Example 3-2 was 10 mm, Comparative Example 3-3 was 5 mm, and Comparative Example 3-4 was 2 mm. The hardness distribution in each of Comparative Examples 3-1 to 3-4 is shown in FIG. 24.

In addition, the feeding speed of the steel pipe in each of Comparative Examples 3-1 to 3-4 was constantly set to 70 mm/second.

In each of Examples 3-1 to 3-3 and Comparative Examples 3-1 to 3-4, the width of the non-quenching portion formed by the manufacturing method for a bent member and the formation situation of the base metal hardness portion are shown in Table 3.

TABLE 3

| | Width dimension of non-quenching portion | Formation situation of base metal hardness portion |
|---|---|---|
| Example 3-1 | 22 mm | Exist |
| Example 3-2 | 24 mm | Exist |
| Example 3-3 | 24 mm | Exist |
| Comparative Example 3-1 | 47 mm | Exist |
| Comparative Example 3-2 | 32 mm | Non-exist |
| Comparative Example 3-3 | 13 mm | Non-exist |
| Comparative Example 3-4 | 0 mm | Non-exist |

As shown in Table 3, compared to Comparative Examples 3-1 to 3-4, in Examples 3-1 to 3-3, the width of the formed non-quenching portion could be smaller. In addition, the base metal hardness portion could be formed in each of Examples 3-1 to 3-3. However, the base metal hardness portion could not be formed in each of Comparative Examples 3-2 to 3-4.

INDUSTRIAL APPLICABILITY

According to the above-described embodiments, it is possible to prevent the fatigue fracture of the chuck holding the front end section of the steel material, and it is possible to provide the manufacturing method for a bent member and the hot-bending apparatus for a steel material in which productivity and economic efficiency are improved.

BRIEF DESCRIPTION OF THE REFERENCE SYMBOLS

0: HOT-BENDING APPARATUS
1: STEEL PIPE
1*a*: HEATED PORTION
1*b*: FRONT END SECTION
1*c*: BENT PORTION
1*d*: REAR END SECTION
2: SUPPORT DEVICE (SUPPORT MECHANISM)
3: FEEDING DEVICE (FEEDING MECHANISM)
4: MOVABLE ROLLER DIE
4*a*: ROLLER PAIR
5: INDUCTION HEATING DEVICE (INDUCTION HEATING MECHANISM)
6: COOLING DEVICE (COOLING MECHANISM)
9: DRIVE DEVICE (DRIVE MECHANISM)
10: CHUCK
10*a*: LARGE-DIAMETER PORTION
10*b*: SMALL-DIAMETER PORTION (CLICK)
11: CHUCK
11*a*: LARGE-DIAMETER PORTION
11*b*: SMALL-DIAMETER PORTION (CLICK)
26: FIRST TEMPERATURE MEASUREMENT MECHANISM
27: SHAPE MEASUREMENT MECHANISM
28: SECOND TEMPERATURE MEASUREMENT MECHANISM
29: CONTROLLER

The invention claimed is:

1. A manufacturing method for a bent member, comprising the steps of:
a holding step of holding one end portion of a long steel material having an opening end in a longitudinal direction by a chuck;
a feeding step of feeding the steel material along the longitudinal direction with the one end portion as a head after the holding step;
a heating step of forming a heated portion by high-frequency induction heating to an exterior portion of the steel material in the longitudinal direction;
a bending step of applying a bending moment to the heated portion by moving the chuck in a three-dimensional direction; and
a cooling step of cooling the heated portion by injecting a cooling medium to the heated portion after the bending step,
wherein when the heating step is started,
the chuck is cooled by the cooling medium, and
a heating amount, which is applied to the one end portion when the heated portion is formed on the one end portion, is greater than that of an upstream side adjacent portion which is adjacent to an upstream side of the one end portion as seen along a feeding direction of the steel material,
wherein a part of the chuck is located in an interior of the steel member when the heating step is started.

2. The manufacturing method for a bent member according to claim 1,
wherein the heating amount applied to the one end portion when the heated portion is formed on the one end portion is greater than that of the upstream side adjacent portion when the heating step is started by changing at least one of a feeding speed of the steel material in the longitudinal direction in the feeding step and a heating amount which is applied to the portion in the heating step.

3. The manufacturing method for a bent member according to claim 1,
wherein the heating amount applied to the one end portion when the heated portion is formed on the one end portion is greater than that of the upstream side adjacent portion by starting the feeding step after a predetermined time from the heating step is started.

4. The manufacturing method for a bent member according to claim 1, further comprising:
a temperature measuring step of measuring a temperature of the steel material at a plurality of points in the longitudinal direction,
wherein in the feeding step, a feeding speed of the steel material in the longitudinal direction is determined based on a temperature measurement result obtained in the temperature measuring step.

5. The manufacturing method for a bent member according to claim 1,
wherein a heating amount applied to the other end portion of the steel material in the longitudinal direction when the heated portion is formed on the other end portion is greater than that of a downstream side adjacent portion adjacent to a downstream side of the other end portion as seen along the feeding direction of the steel material.

6. The manufacturing method for a bent member according to claim 5,
wherein the heating amount applied to the other end portion when the heated portion is formed on the other end portion is greater than that of the downstream side adjacent portion by changing at least one of a feeding speed of the steel material in the longitudinal direction in the feeding step and a heating amount in the heating step before the high-frequency induction heating stops in the heating step.

7. The manufacturing method for a bent member according to claim 6,
wherein the heating amount applied to the other end portion when the heated portion is formed on the other end portion is greater than that of the downstream side adjacent portion by stopping a feeding of the steel material in the feeding step before the high-frequency induction heating stops.

8. The manufacturing method for a bent member according to claim 1,
wherein a heating amount in the heating step is controlled to satisfy all the conditions of:
a first condition in which a heating temperature of a click of the chuck is 500° C. or lower;
a second condition in which a heating temperature of the heated portion is higher than an Ac3 point when the bending moment is applied to the heated portion in the bending step; and a third condition in which a highest arrival temperature of the steel material is lower than or equal to a temperature at which a particle-coarsening of the steel material proceeds or is lower than or equal to a temperature at which a toughness of the steel material decreases.

9. The manufacturing method for a bent member according to claim 1, wherein the heating step includes:

a first heating step of forming a first heated portion at a position between the one end portion and the other end portion of the steel material;

a second heating step of forming a second heated portion at a position on the upstream side of the first heated portion of the steel material; and a heating stop step of forming a non-quenching portion between the first heated portion and the second heated portion, by stopping the high-frequency induction heating between the first heating step and the second heating step, wherein a heating amount which is applied to the second heated portion is greater than a heating amount which is applied to the first heated portion when the second heating step is started.

10. The manufacturing method for a bent member according to claim 9, wherein a width dimension of the non-quenching portion is 0.15 times or more and 1.40 times or less of a heating width by the high-frequency induction heating as seen along the longitudinal direction.

11. A hot-bending apparatus for a steel material, comprising:

a chuck which holds one end portion of a long steel material having an opening end in a longitudinal direction;

a drive mechanism which moves the chuck in a three-dimensional direction;

a feeding mechanism which feeds the steel material along the longitudinal direction with the one end portion as a head;

an induction heating mechanism which performs high-frequency induction heating on an exterior portion of the steel material in the longitudinal direction to form a heated portion;

a cooling mechanism which injects a cooling medium to the heated portion to cool the heated portion; and a controller which controls the chuck, the drive mechanism, the feeding mechanism, the induction heating mechanism, and the cooling mechanism, wherein when the heated portion is formed on the one end portion by the induction heating mechanism the controller controls to satisfy the conditions of:

a heating amount is greater than that of an upstream side adjacent portion adjacent to an upstream side of the one end portion as seen along a feeding direction of the steel material; and the cooling mechanism cools the chuck by the cooling medium, and wherein a part of the chuck is located in an interior of the steel material when the high-frequency induction heating is started.

12. The hot-bending apparatus for a steel material according to claim 11, wherein the controller controls to cause a heating amount applied to the other end portion of the steel material in the longitudinal direction by the induction heating mechanism to be greater than that of a downstream side adjacent portion adjacent to a downstream side of the other end portion as seen along the feeding direction of the steel material when the heated portion is formed on the other end portion.

13. The hot-bending apparatus for a steel material according to claim 11, wherein the controller controls the induction heating mechanism to form:

a first heated portion at a position between the one end portion and the other end portion of the steel material;

a second heated portion at a position on the upstream side of the first heated portion of the steel material; and a non-quenching portion at a position between the first heated portion and the second heated portion.

14. The hot-bending apparatus for a steel material according to claim 11, further comprising:

at least one of a first temperature measurement mechanism which measures a temperature of the one end portion, a second temperature measurement mechanism which measures a temperature of the heated portion, and a shape measurement mechanism which measures an outline distortion amount of the one end portion, wherein the controller controls at least one of the feeding mechanism and the induction heating mechanism so that at least one of the temperature of the one end portion, the temperature of the heated portion, and the outline distortion amount of the one end portion is within a predetermined range.

* * * * *